US006025818A

United States Patent [19]

Okano

[11] Patent Number: 6,025,818

[45] **Date of Patent: *Feb. 15, 2000**

[54] METHOD FOR CORRECTING PIXEL DATA IN A SELF-LUMINOUS DISPLAY PANEL DRIVING SYSTEM

[75] Inventor: Takashi Okano, Yamanashi-ken, Japan

[73] Assignee: Pioneer Electronic Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/576,133

[22] Filed: Dec. 21, 1995

[30] Foreign Application Priority Data

| | | | |
|---|---|---|---|
| Dec. 27, 1994 | [JP] | Japan | 6-326041 |
| May 31, 1995 | [JP] | Japan | 7-133822 |
| Oct. 4, 1995 | [JP] | Japan | 7-257838 |

[51] Int. Cl.[7] ..... G09G 3/28; N04H 9/12

[52] U.S. Cl. ..... 345/63; 345/214; 348/797

[58] Field of Search ..... 345/12, 89, 147, 345/149, 63, 214, 138, 55; 348/797

[56] References Cited

U.S. PATENT DOCUMENTS

| | | | |
|---|---|---|---|
| 5,298,915 | 3/1994 | Bassetti, Jr. | 345/149 |
| 5,412,395 | 5/1995 | Maeda et al. | 345/149 |
| 5,475,448 | 12/1995 | Saegusa | 345/214 |
| 5,504,504 | 4/1996 | Markandey et al. | 345/214 |
| 5,548,305 | 8/1996 | Rupel | 345/149 |
| 5,627,555 | 5/1997 | den Hollander | 345/12 |
| 5,638,091 | 6/1997 | Sarrasin | 345/149 |

FOREIGN PATENT DOCUMENTS

| | | | |
|---|---|---|---|
| 3-145691 | 1/1989 | Japan | 345/149 |

*Primary Examiner*—Amare Mengistu

*Attorney, Agent, or Firm*—Nikaido Marmelstein Murray & Oram LLP

[57] ABSTRACT

In a self-luminous display panel driving system, one field of a composite video signal is divided into N sub-fields, luminance of each pixel is set by a pixel data. The pixel data comprises N bits corresponding to the number of the sub-field. A present pixel data of a pixel is compared with a prior pixel data of a same pixel and a change between a data of a highest luminance and a data of a luminance of a one digit lower is detected. An inter-frame change signal is produced when a change is detected. In response to the inter-frame change signal, the present pixel data is corrected so as to change the sub-field of the present pixel data.

10 Claims, 24 Drawing Sheets

A/D
3
DATA CORRECTING CIRCUIT
7
FRAME MEMORY
8
OUTPUT PROCESSING CIRCUIT
10
VIDEO SIGNAL PROCESSING CIRCUIT
1
COMPOSITE VIDEO SIGNAL
SYNC SIGNAL SEPARATION CIRCUIT
5
TIMING PULSE GENERATING CIRCUIT
6
MEMORY CONTROL CIRCUIT
9
READ OUT TIMING PULSE GENERATING CIRCUIT
20
ROW ELECTRODE DRIVER
11
DATA ELECTRODE DRIVER
13
x1
y1
x2
y2
x3
y3
xn
yn
D1
D2
D3
Dm−1
Dm
12

FIG.3

| CHANGING PATTERN | PIXEL DATA OF FRAME (n−1) | PIXEL DATA OF FRAME (n) | FALSE CONTOUR | AND GATE PRODUCING HIGH LEVEL OUTPUT | CORRECTING DATA | CORRECTING QUANTITY | CORRECTED PIXEL DATA OF FRAME (n) |
|---|---|---|---|---|---|---|---|
| | | | | | | | |
| A1 | 10000000 | 01111111 | DARK STRIPE | $35_4$ | SUBTRACT (00000001+$a_1$) | 00100000 | 10011111 |
| B1 | 01000000 | 00111111 | DARK STRIPE | $35_5$ | SUBTRACT (00000001+$b_1$) | 00010000 | 01001111 |
| C1 | 00100000 | 00011111 | DARK STRIPE | $35_6$ | SUBTRACT (00000001+$c_1$) | 00001000 | 00100111 |
| | | | | | | | |
| A2 | 01111111 | 10000000 | BRIGHT STRIPE | $35_1$ | SUBTRACT (00000001+$a_2$) | 00100000 | 01100000 |
| B2 | 00111111 | 01000000 | BRIGHT STRIPE | $35_2$ | SUBTRACT (00000001+$b_2$) | 00010000 | 00110000 |
| C2 | 00011111 | 00100000 | BRIGHT STRIPE | $35_3$ | SUBTRACT (00000001+$c_2$) | 00001000 | 00011000 |
| | | | | | | | |
| A3 | 10000000 | 01111111 | BRIGHT STRIPE | $35_4$ | SUBTRACT (00000001+$a_3$) | 00011111 | 01100000 |
| B3 | 01000000 | 00111111 | BRIGHT STRIPE | $35_5$ | SUBTRACT (00000001+$b_3$) | 00001111 | 00110000 |
| C3 | 00100000 | 00011111 | BRIGHT STRIPE | $35_6$ | SUBTRACT (00000001+$c_3$) | 00000111 | 00011000 |
| | | | | | | | |
| A4 | 01111111 | 10000000 | DARK STRIPE | $35_1$ | ADD (00000001+$a_4$) | 00011111 | 10011111 |
| B4 | 00111111 | 01000000 | DARK STRIPE | $35_2$ | ADD (00000001+$b_4$) | 00001111 | 01001111 |
| C4 | 00011111 | 00100000 | DARK STRIPE | $35_3$ | ADD (00000001+$c_4$) | 00000111 | 00100111 |

23
HL
LH
PREPROCESSING CIRCUIT
23d
(±1)
ONE-FRAME DELAY CIRCUIT
23a
8-CLOCK DELAY CIRCUIT
23c
1
2
3
4
9
ADD
23e
23f
23g
23h
D LATCH
23i
C

F (n)

F (n+1)

F (n+2)

F (n+3)

METHOD FOR CORRECTING PIXEL DATA IN A SELF-LUMINOUS DISPLAY PANEL DRIVING SYSTEM

BACKGROUND OF THE INVENTION

The present invention relates to a method for controlling tones in a self-luminous display such as a plasma display panel and an electroluminescence display panel, and more particularly to a method for preventing false contouring.

There has been known an image display device having a self-luminous display panel such as a plasma display panel and an electroluminescence panel. The plasma display panel utilizes a gas discharge so that the quantity of the light emitted therefrom cannot be continually controlled. Hence the emission is actuated by pulses, that is, the brightness of the image on the display is represented by the number of the pulses, namely, by the frequency of the emission. The image becomes brighter as the number of the emission, or the frequency per unit time increases so that the tone can be controlled.

In order to drive the panel so as to show a picture thereon, each field of a composite video signal is divided into a plurality of sub-fields on a time axis. The sub-fields are differently weighted in order to impart a tone to the image on the display. Namely, a digital video signal is reproduced not by a dot sequential scanning of each pixel, but by repeating a plane sequential scanning of the pixel in accordance with the weight of the pixel.

As shown in FIG. 22*a*, each field is divided into eight sub-fields $D_8$ to $D_1$, corresponding to the 8 bits of a pixel data so that, in order to complete a field, a bit plane scanning takes place. The time length of each sub-field is determined in accordance with its weight. The ratio of weights from the first sub-field to the eighth sub-field are, for example, $128(2^7):64(2^6):32(2^5):16(2^4):8(2^3):4(2^2):2(2^1):1(2^0)$, as shown in FIG. 22*b*. For example, when the logic value of the eighth position and hence the highest order bit of the pixel data is "1", which indicates the logic for emitting, the light is emitted 128 times during the sub-field $D_8$. When the logic value of the eighth bit is "0", light is not emitted at all during the sub-field $D_8$. When the seventh bit of the pixel data is "1", the light is emitted 64 times during the sub-field $D_7$. When the plane sequential scanning is thus carried out eight times, the light from each pixel is visually recognized by the viewer as a brightness corresponding to the total of the pulses of eight sub-fields. Thus, the tone of $2^8$ (256) steps, from 0 to 255, can be obtained by combining the eight weights.

FIG. 22*c* shows, as examples, the light emitting periods corresponding to each sub-field of the eight-bit pixel data, "11111111", "10000000", and "100000001".

The above described sub-field system is an excellent system which enables to realize various tones in a single-tone display which is capable of indicating only two tones "1" and "0". However, a false contouring due to visual characteristics inherently occurs in the system. The false contouring is a phenomenon where a flat image, the levels of signals thereof cross the tone levels such as 128, 64, 32 and 16, which are the powers of 2. As a result, contour lines in stripes appear on the display as if the tones of the image are lost. The phenomenon becomes strikingly apparent when an image of a flat mass moves on the display and is hardly recognized when the image is stationary, that is when a still picture stored in a memory is shown. Namely, the false contours are recognized only when an image moves about level boundaries. In addition, when a load of a still visual signal fluctuates due to a noise included therein, the false contours also appear.

The cause of the false contouring is described with reference to FIGS. 23*a*, 23*b*, 24*a*, 24*b*, 24*c* and 24*d*. As shown in FIG. 23*a*, when the tone is decreased so that the number of pulses decreases from 128 to 127 in the next field, the emission at the sub-field $D_8$ is stopped and the emission at the sub-fields $D_7$ to $D_1$ is started. The difference in the levels of the tone corresponds to 1 least significant bit (LSB). In such a case, a transition period $t_1$ where the emission of light does not occur is so long that the viewer senses it as though the tone is decreased, although momentarily. As a result, there are formed on the display, stripes similar to isobaric curves in a weather map. Although the tone of each pixel is decreased only one step, since the stripes move with the movement of the image, they become apparent to the viewer.

FIG. 23*b* shows a case where bright contour lines are formed. When the number of pulses is increased from 127 to 128, emission at the sub-fields $D_7$ to $D_1$ is stopped and emission at the sub-field $D_8$ is started. A transition period $t_2$ is so short that the luminous density is increased. Hence a bright stripe appears on the display.

There are displays where the sub-field are arranged starting from the sub-field with a smallest weight as shown in FIGS. 24*a* to 24*d*. Each space before the sub-fields indicates a constant non-light emitting period for selecting the next sub-field at which the light is emitted. The spaces are omitted in FIGS. 23*a* and 23*b* for the sake of simplicity.

As shown in FIG. 24*a* when a pixel data is "11111111", corresponding to 255 pulses, the light is flashed during all of the sub-fields. When the pixel data is "10000000", corresponding to 128 pulses, the light is emitted only during the sub-field $D_8$ (FIG. 24*b*). FIG. 24*c* shows an example where the data is "01111111" corresponding to 127 pulses, so that the light is emitted at sub-fields $D_1$ to $D_7$. When the data changes to "10000000", a transition period $t_5$ shown in FIG. 24*d* becomes much longer than periods $t_3$ and $t_4$ which are shown respectively in FIGS. 24*b* and 24*c*. As a result, dark stripes appear on the display. To the contrary, when the data changes from "10000000" to "01111111", the non-light emitting period becomes short so that bright stripes appear.

In order to restrain the false contouring, Japanese Patent Application Laid-Open Nos. 2-291597, 3-145691 and 4-211294 propose to change the arrangement of the sub-fields. For example, the emitting period for a sub-field corresponding to the most significant bit (MSB) of the pixel data is positioned between those of the lower bits so that the difference in luminance, particularly that of the sub-field of the MSB is decreased. However, experiments have shown that the false contours are observed in the lower bit levels.

SUMMARY OF THE INVENTION

An object of the present invention is to provide a method for correcting pixel data in a self-luminous display panel driving system, where the false contouring is prevented.

According to the present invention, there is provided a method for correcting pixel data in a self-luminous display panel driving system, wherein one field of a composite video signal is divided into N sub-fields, luminance of each pixel is set by a pixel data comprising N bits corresponding to the number of the sub-field and each of digit positions of the N bits represents a weight for the luminance.

The method comprising steps of comparing a present pixel data of a pixel with a prior pixel data of a same pixel, detecting whether there is a change between a data of a highest luminance and a data of a luminance of a one digit lower in the comparison, and producing an inter-frame change signal when a change is detected, correcting the present pixel data in response to the inter-frame change signal so as to change the sub-field of the present pixel data.

In a method, the correcting data is performed so as to reduce a period between sub-fields of the prior pixel data and the present pixel data.

In another method, the correcting data is performed so as to increase a period between sub-fields of the prior pixel data and the present pixel data.

The other objects and features of this invention will become understood from the following description with reference to the accompanying drawings.

BRIEF DESCRIPTION OF DRAWINGS

FIG. 3 is a table showing correcting data for correcting pixel data in the correcting circuit of FIG. 2;

DETAILED DESCRIPTION OF THE PREFERRED EMBODIMENTS

Figure 1:
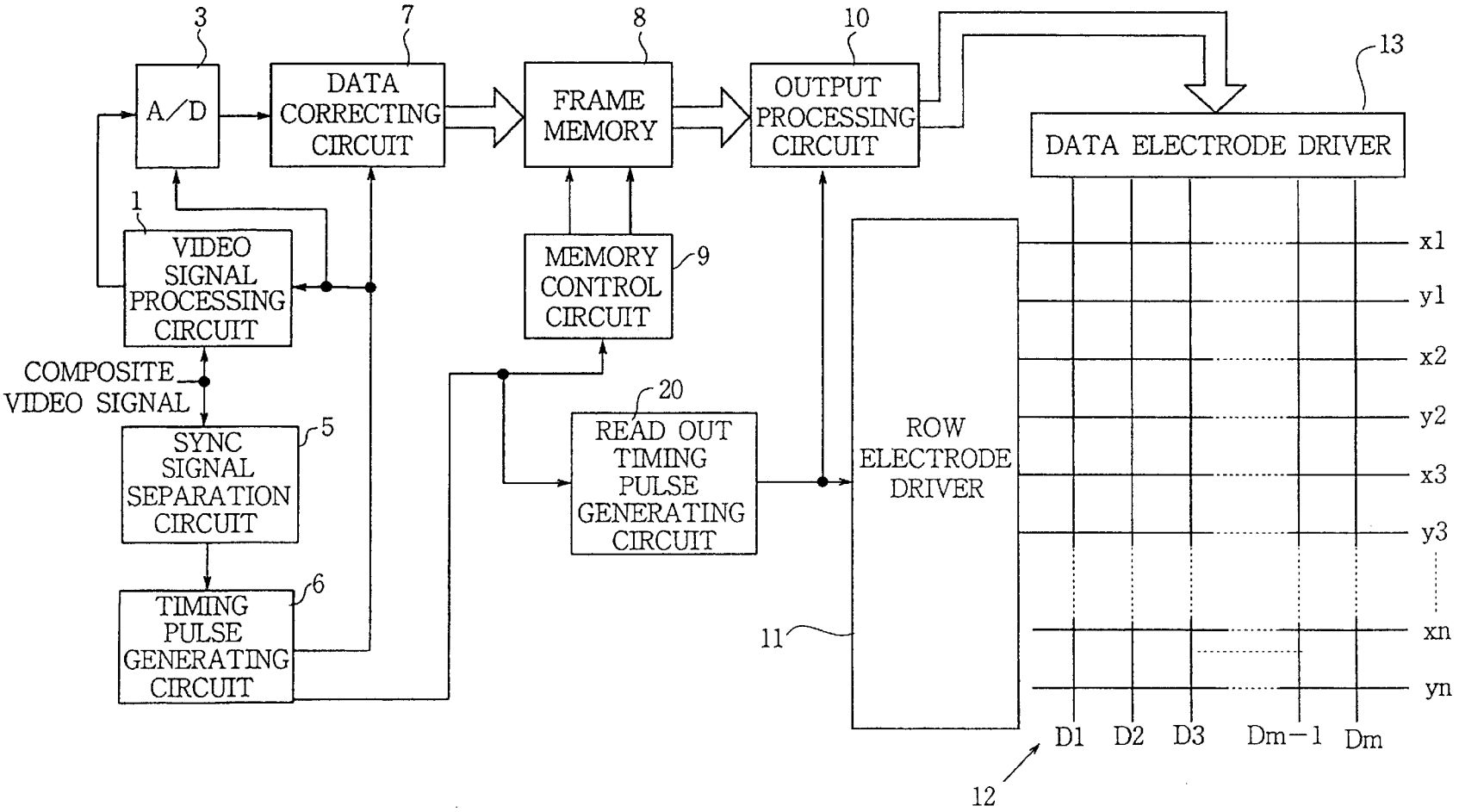
FIG. 1 is a block diagram showing a self-luminous display panel and a control system thereof according to the present invention.

Referring to FIG. 1, a self-luminous display device of the present invention such as a plasma display device comprises a video signal processing circuit 1 where a composite video signal is applied. The video signal processing circuit 1 extracts from the composite video signal, R video signal corresponding to a red video component, G video signal corresponding to a green video component and B video signal corresponding to a blue video component. The R, G and B video signals are applied to an A/D converter 3. The composite video signal is further applied to a sync signal separation circuit 5 which operates to extract horizontal and vertical synchronizing signals from the input composite video signal. The horizontal and vertical synchronizing signals are applied to a timing pulse generating circuit 6 which produces various timing pulses based on the synchronizing signals. The timing pulses are applied to the A/D converter 3 which is operated in synchronism with the timing pulse, so as to convert the R video signal, G video signal and B video signal into pixel data signal for each pixel provided in a display panel 12. Each pixel data in the present invention is an 8-bit pixel data, the eight digits of which corresponds to the number of sub-fields. The pixel data signal is corrected by a data correcting circuit 7, which will later be described in detail, and fed to a frame memory 8. The timing pulse from the timing pulse generating circuit 6 is also fed to the data correcting circuit 7.

The timing pulses is further applied to a data control circuit 9 and a read out timing pulse generating circuit 20. The memory control circuit 9 produces writing pulses and reading pulses corresponding to the timing pulse from the timing pulse generating circuit 6 and applies the pulse to the frame memory 8. The frame memory 8 stores the pixel data from the A/D converter 3 in order in accordance with the matrix of the panel in response to each writing pulse, and reads the pixel data for applying the data to an output processing circuit 10 in response to the reading pulse.

The output processing circuit 10 is operated to send the data voltages of 8 digits to a data electrode driver 13 of the display panel 12. The electrode driver 13 applies a high data voltage (1) or a low data voltage (0) for every digit of the pixel data dependent on the pixel data to designated data electrodes $D_1$, $D_2$, $D_3$ . . . $D_{m-1}$, and $D_m$ at a corresponding timing.

The read out timing pulse generating circuit 20 produces a scanning pulse for starting a discharge for emitting light, sustaining pulse for sustaining the emitting of the light and an erasing pulse for stopping the discharge and erasing the light. The scanning, sustaining and erasing pulses are applied to a row electrode driver 11 of the display panel 12.

The display panel 12 comprises data electrodes $D_1$, $D_2$, $D_3$ . . . $D_{m-1}$, and $D_m$, odd row electrodes $X_1$, $X_2$, $X_3$ . . . , $X_{n-1}$, and $X_n$, and even row electrodes $Y_1$, $Y_2$, $Y_3$ . . . $Y_{n-1}$, and $Y_n$ for performing interlaced scanning. Each of the data electrodes intersects each of the odd and even row electrodes to form a pixel. The data electrode driver 13 is connected to the data electrodes for driving the electrodes. The row electrode driver 11 is connected to the row electrodes $X_1$, $X_2$ . . . $X_n$ and $Y_1$, $Y_2$ . . . $Y_n$. Such a plasma display device is well-known so that a further description thereof is omitted.

Figure 2:
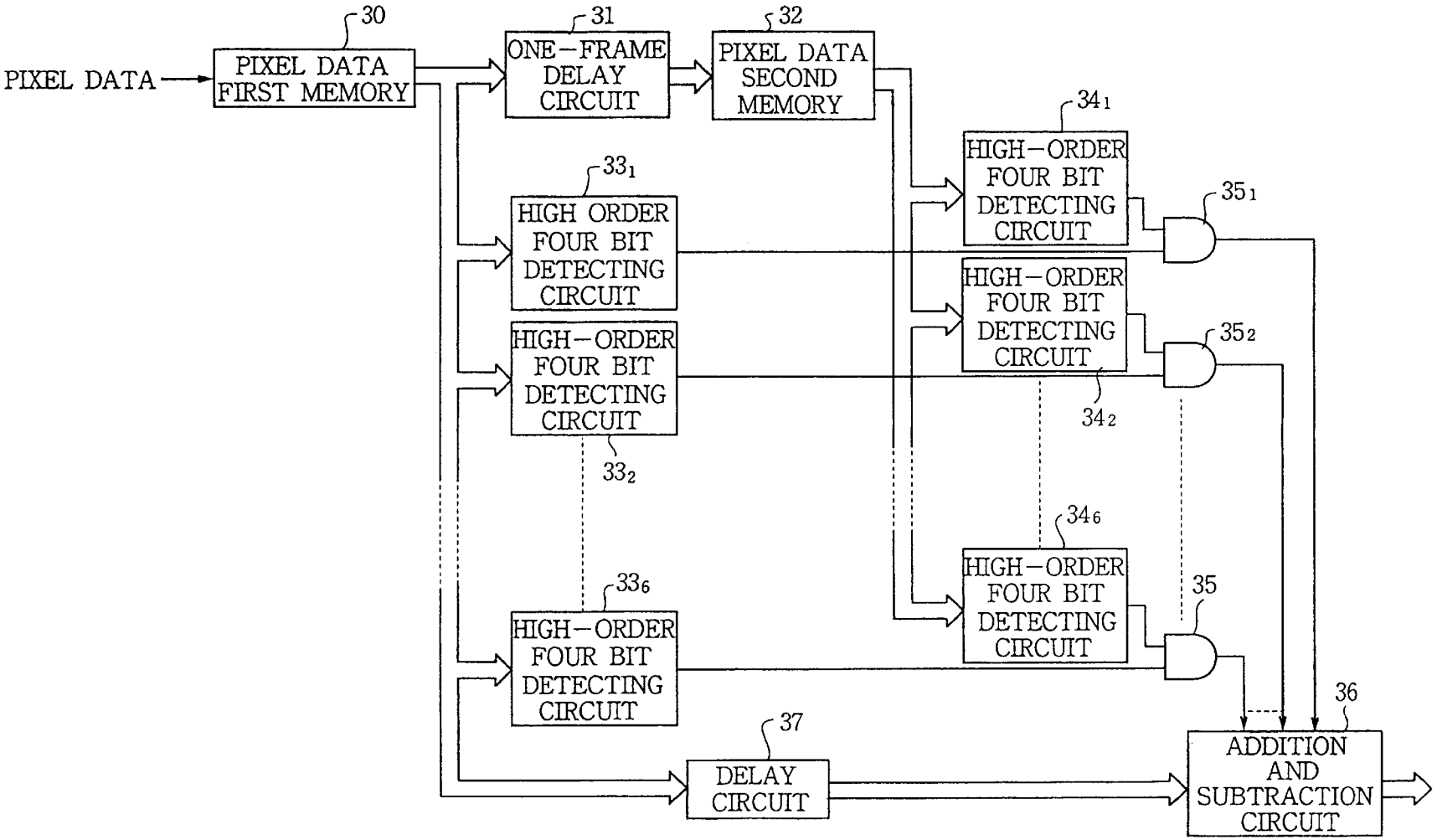
FIG. 2 is a block diagram of a correcting circuit provided in the control system of FIG. 1.

Referring to FIG. 2, the data correcting circuit 7 has a pixel data first memory 30 wherein pixel data for each pixel from the A/D converter 3 is fed. The data is an 8-bit data which is expressed as "$d_8$, $d_7$, . . . $d_1$". Namely, each bit is expressed as $d_n$ (n=1 to 8) where n indicates the position. The luminance of the bit increases as the number n becomes larger. The data stored in the memory 30 is further applied to a pixel data second memory 32 through a one-frame delay circuit 31. Accordingly, the pixel data second memory 32 always stores a pixel data of one frame before that of the pixel data first memory 30.

The present pixel data stored in the pixel data first memory 30 is fed to a high-order four bits detecting circuits $\mathbf{33}_1$ to $\mathbf{33}_6$ and the last pixel data stored in the pixel data second memory 32 is fed to high-order four bits detecting circuits $\mathbf{34}_1$ to $\mathbf{34}_6$. The high-order four bits detecting circuits $\mathbf{33}_3$ to $\mathbf{33}_6$ and $\mathbf{34}_3$ to $\mathbf{34}_5$ to $\mathbf{33}_5$ are omitted in the figure. Each of the four bits detecting circuits $\mathbf{33}_1$ to $\mathbf{33}_6$ and $\mathbf{34}_1$ to $\mathbf{34}_6$ is provided with a preset data which are shown in the following table.

TABLE

| DETECTING CIRCUIT | PRESET DATA | DETECTING CIRCUIT | PRESET DATA |
|---|---|---|---|
| $33_1$ | 1000 | $43_1$ | 0111 |
| $33_2$ | 0100 | $43_2$ | 0011 |
| $33_3$ | 0010 | $43_3$ | 0001 |
| $33_4$ | 0111 | $43_4$ | 1000 |
| $33_5$ | 0011 | $43_5$ | 0100 |
| $33_6$ | 0001 | $43_6$ | 0010 |

The high-order four bits detecting circuits $\mathbf{33}_1$ and $\mathbf{34}_1$ are connected to input terminals of an AND gate $\mathbf{35}_1$. Similarly, AND gates $\mathbf{35}_2$ to $\mathbf{35}_6$ to which output signals of the high-order four bits detecting circuits $\mathbf{33}_2$ to $\mathbf{34}_6$ and $\mathbf{34}_2$ to $\mathbf{34}_6$ are respectively fed are provided. Namely, when the high-order four bits of the present pixel data fed from the pixel data first memory 30 coincides with the preset data in any of the detecting circuits $\mathbf{33}_1$ to $\mathbf{33}_6$, the circuit applies a high level voltage to the corresponding AND gate. When the high-order four bits of the last pixel data fed from the pixel data second memory 32 coincides with the preset data in any of the detecting circuits $\mathbf{34}_1$ to $\mathbf{34}_6$, the circuit applies a high level voltage to the corresponding AND gate. For example, when the high-order four bits of the present pixel data is "1000" and high-order four bits of the last pixel data is "0111", the AND gate $\mathbf{35}_1$ are fed with high level input signals from the high-order four bit detecting circuits $\mathbf{33}_1$ and $\mathbf{34}_1$, thereby producing a high level output signal.

Each of the high-order four bits detecting circuits $\mathbf{33}_1$ to $\mathbf{33}_6$ and $\mathbf{34}_1$ to $\mathbf{34}_6$ actually comprises four exclusive OR gates to which exclusive OR results of respective bit values of high-order four bits of the pixel data and the preset data are fed, and four NOR gates connected to the exclusive OR gates.

The high level output signals from the AND gates $\mathbf{35}_1$ to $\mathbf{35}_6$ are applied to an addition and subtraction circuit 36 to which the present pixel data from the pixel data first memory 30 is also fed through a delay circuit 37. The addition and subtraction circuit 36 adds to or subtracts from the present pixel data to produce a correcting data predetermined in accordance with the AND gate from which the high level output signal is fed. The delay time set in the delay circuit 37 is so determined as to compensate the time it took for the detecting circuits $\mathbf{33}_1$ to $\mathbf{33}_6$and $\mathbf{34}_1$ to $\mathbf{34}_6$ and the AND gates $\mathbf{35}_1$ to $\mathbf{35}_6$ to operate.

Figure 23A:
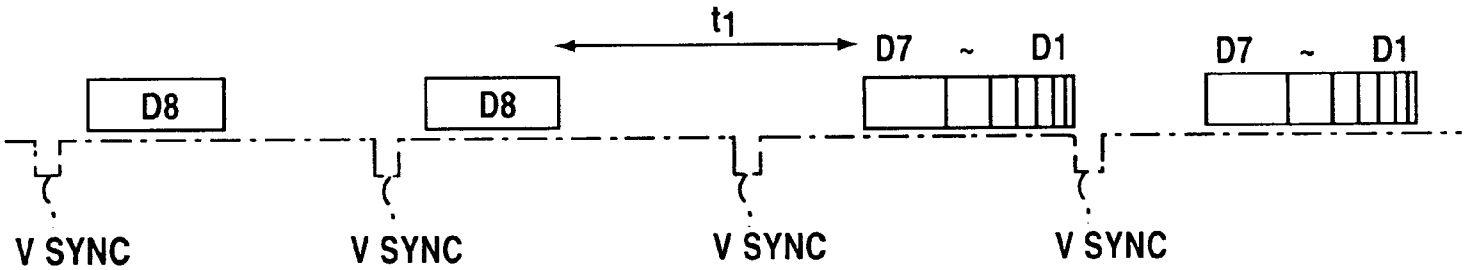
FIG.23a PRIOR ART
FIGS. 23*a* and 23*b* are charts showing the light-emitting periods in a conventional system which cause false contouring.
Figure 23B:
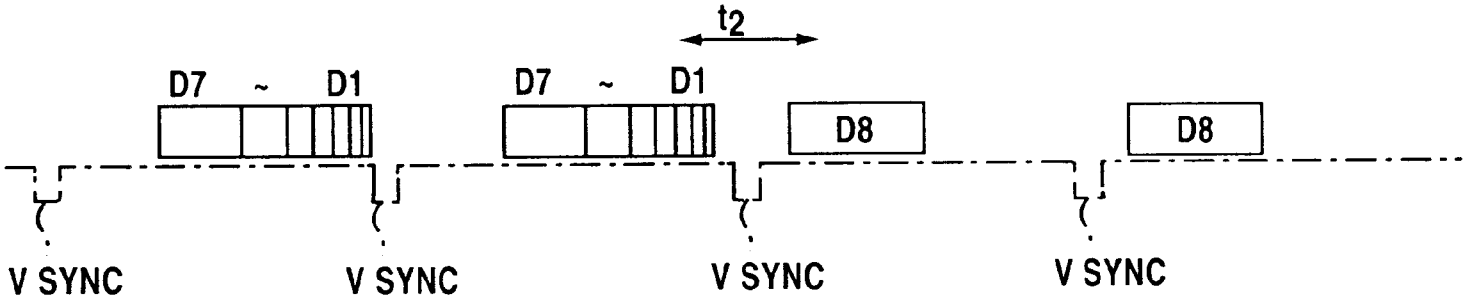
FIG.23b PRIOR ART
Figure 24A:
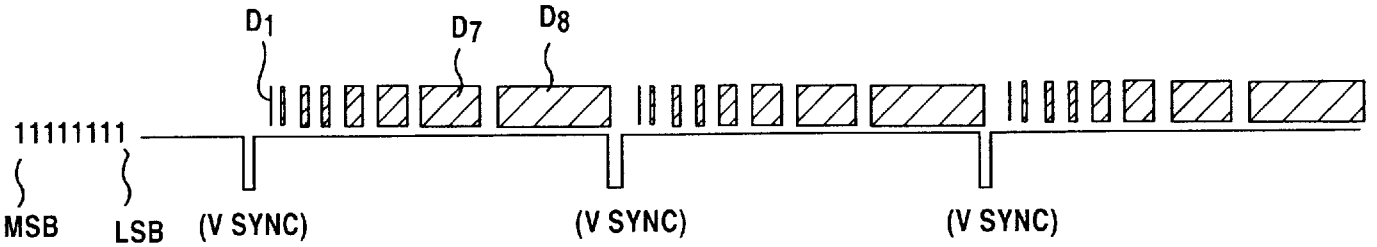
FIG.24a PRIOR ART
FIGS. 24*a* to 24*d* show the light-emitting periods in a conventional system having other arrangements of the sub-fields.
Figure 24B:
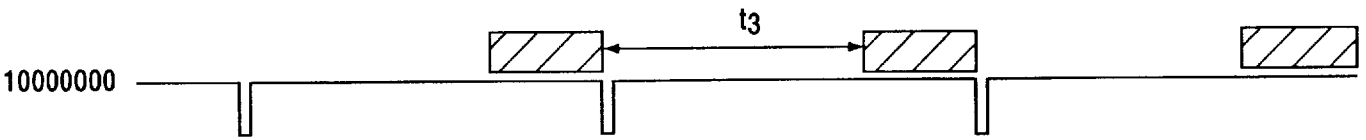
FIG.24b PRIOR ART
Figure 24C:
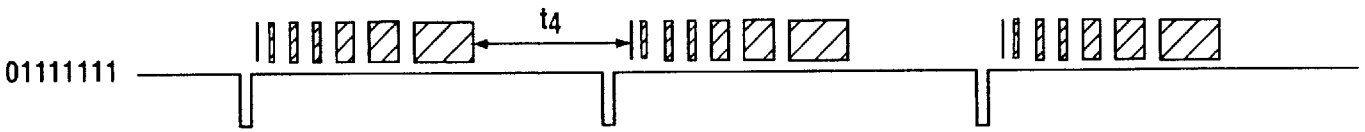
FIG.24c PRIOR ART
Figure 24D:
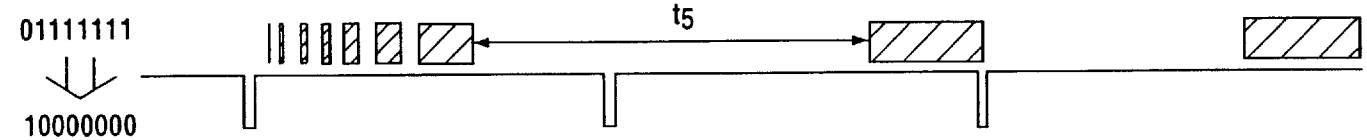
FIG.24d PRIOR ART

The correcting data for each of changing patterns of the pixel data between the frames is shown in the table of FIG. 3. Patterns $A_1$, to $C_2$ show cases where the arrangement of sub-fields begins with the most weighted sub-field $D_8$ and ends with the least weighted sub-field $D_1$ as shown in FIG. 23*a*, and patterns A3 to $C_4$ show cases where the arrangement begins with the least weighted sub-field $D_1$ and ends with the most weighted sub-field $D_8$ as shown in FIG. 24*a*. As shown in FIG. 3, the manner in which false contour appears and whether to increase or decrease the luminance to correct the data in the patterns $A_1$ to $C_2$ are changed in the patterns $A_3$ to $C_4$.

In the changing pattern $A_1$, the pixel data, for example, changes from "0000000" in a frame (n−1) to "01111111" in a frame (n). The false contours appear as a dark stripe. In order to prevent the false contour, correcting data "100000001+$a_1$" which is "00100000" is added to the pixel data "01111111". As a result, the present pixel data "01111111" is corrected to "10011111".

The high-order four bits detecting circuits $\mathbf{33}_1$ and $\mathbf{34}_1$ detect the changing patterns $A_2$ and $A_4$, and the high-order four bits detecting circuits $\mathbf{33}_2$ and $\mathbf{34}_2$ detect the patterns $B_2$ and $B_4$. Similarly, other patterns are determined by the pairs of detectors $\mathbf{33}_3$ and $\mathbf{34}_3$, $\mathbf{33}_4$ and $\mathbf{34}_4$ and so on. Namely, the addition and subtraction circuit 36 has a memory storing the correcting data shown in FIG. 3 and corrects the present pixel data, depending on how the sub-field $D_8$ to $D_1$ are arranged, in accordance with the changing pattern. Alternatively, the memory in the addition and subtraction circuit 36 may store the calculated corrected pixel data so that when any of the changing patterns $A_1$ to $C_4$ is detected, the corrected pixel data is read out to replace the present data without calculating the corrected data.

As can be seen from the table, in the instances where the sub-fields are arranged in the order from the sub-field with the largest weight as in the changing patterns $A_1$ to $C_2$, when the highest bit having the high data voltage (1) in the frame (n−1) changes to the bit of the next lower order in the frame (n) as in patterns $A_1$ to $C_1$, the pixel data is corrected by addition. On the other hand, when the highest bit with the high data voltage changes to the bit of the next higher order as in patterns $A_2$ to $C_2$, the pixel data is corrected by subtraction. Hence the highest bit having the high data voltage of the corrected data becomes the same as that of the data of the previous frame (n−1). For example, in the changing pattern $A_1$, the present pixel data "01111111" of the frame (n) wherein the highest bit is $d_7$, is corrected to "10011111" wherein the highest bit is $d_8$, which is the same bit as the highest bit in the data of last frame (n−1).

When the sub-field are arranged in the order from the sub-field with the least weight as in the changing patterns $A_3$ to $C_4$, when the highest bit having the high data voltage in the frame (n−1) changes to the bit of the next lower order in the frame (n) as in patterns $A_3$ to $C_3$, the pixel data is corrected by subtraction. On the other hand, when the highest bit with the high data voltage changes to the bit of the next higher order as in patterns $A_4$ to $C_4$, the pixel data is corrected by addition. The low-order bits of the resultant corrected data are changes of the low-order bits of the present data. For example, in the changing pattern $A_3$, the present pixel data of the frame (n) is "01111111" and the corrected data is "01100000". The low-order five bits of the corrected data are the changes of those of the present pixel data. In the pattern $B_3$, the data of the present frame (n) "00111111" is replaced by the corrected data "01100000". Namely, the low-order four bits "0000" of the corrected data are change of "1111" which coincides with the low-order four bits of the present data before correction.

Each of the correcting values $a_1$, to $a_4$, $b_1$ to $b_4$, and $c_1$ to $c_4$ is smaller than one half of the data of the last frame (n−1).

The entire correcting circuit 7, or at least the addition and subtraction circuit 36 may be formed as a microprocessor.

The operation of the correcting circuit is described hereinafter with reference to FIGS. 4*a* to 4*c*.

Figure 4A:
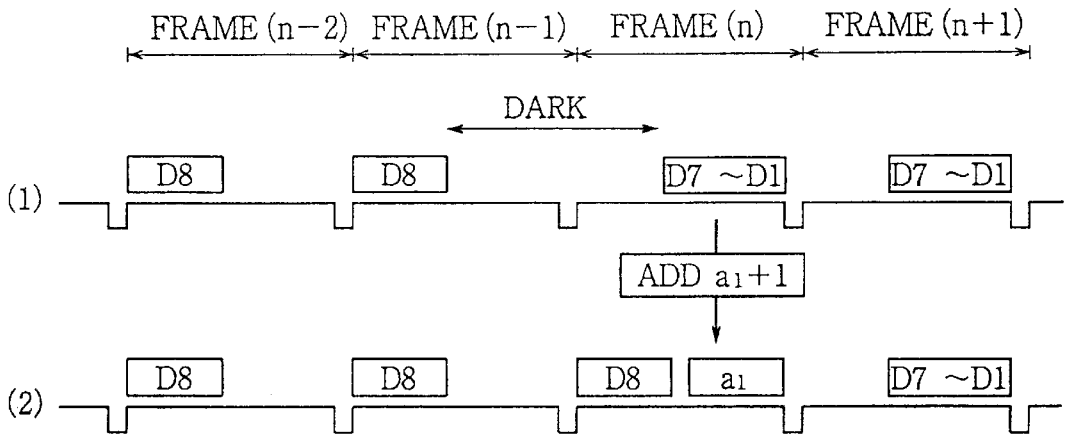
FIGS. 4*a* to 4*c* are charts explaining the correcting operation.

FIG. 4*a* shows an example where the pixel data changes during a period of a frame (n−2) to a frame (n+1), from "10000000", "10000000", "01111111", to "01111111". Chart (1) shows the sub-fields during which the light is emitted when the data is not corrected and chart (2) shows the sub-fields when the data is corrected. In the chart (1), since the length of time between the sub-field $D_8$, which corresponds to the highest light emitting bit, in the frame (n−1) and the sub-fields $D_7$ to $D_1$ in the frame (n) is long as shown between arrows, the non-emitting period becomes longer than the non-emitting periods between the frames (n−2) and (n−1) and between (n) and (n+1). Hence false contours in the form of dark stripes appear due to the persistence.

In order to prevent the false contouring, the data "01111111" of the data for the frame (n) is replaced by a value "10000000+$a_1$" wherein the value $a_1$ is a data such as "11111111" which corresponds to the data where the light is emitted at sub-fields $D_6$ to $D_1$. Hence light is emitted at the sub-fields $D_8$ and $D_6$ to $D_1$ as shown in the chart (2). The non-emitting period is thus shortened so that stripes do not appear on the display.

Figure 4B:
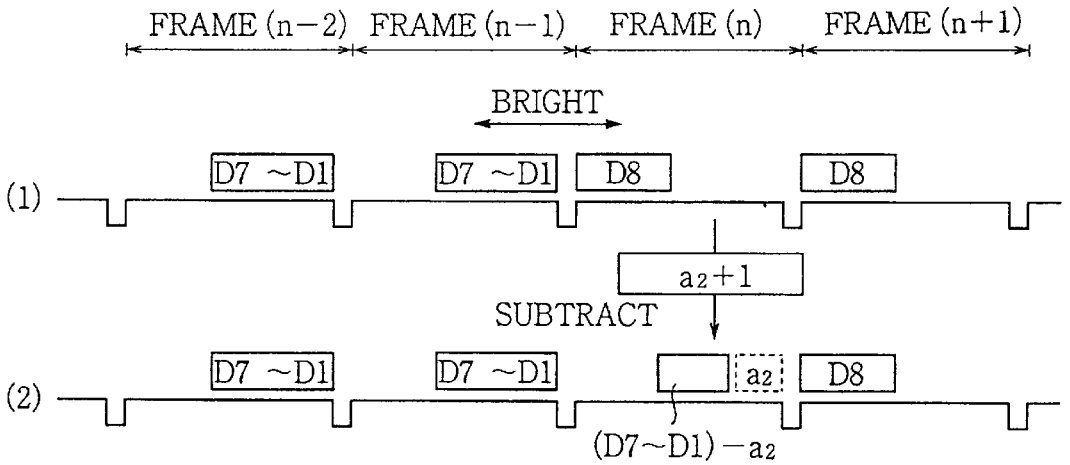

Referring to FIG. 4*b*, when the pixel data changes from "01111111", "01111111", "10000000" to "10000000" during the frames (n−2) to (n+1), the light is emitted at the sub-fields $D_7$ to $D_1$ in the frames (n−2) and (n−1) and at sub-field $D_8$ in the frames (n) and (n+1). Thus, the non-emitting period between the frames (n−1) and (n) becomes extremely shorter compared to those between other frames shown in the chart (1), thereby producing a bright false contour. When the correcting data "$a_2$+1" is subtracted from the data of the frame (n), the corrected data for the frame (n) becomes "01111111−$a_2$", which corresponds to the emitting periods of the sub-fields, ($D_7$ to $D_1$)−$a_2$. Hence the emitting periods in the frames (n−1) and (n) are separated from one another as shown in the chart (2), so that the bright false contour is prevented.

Figure 4C:
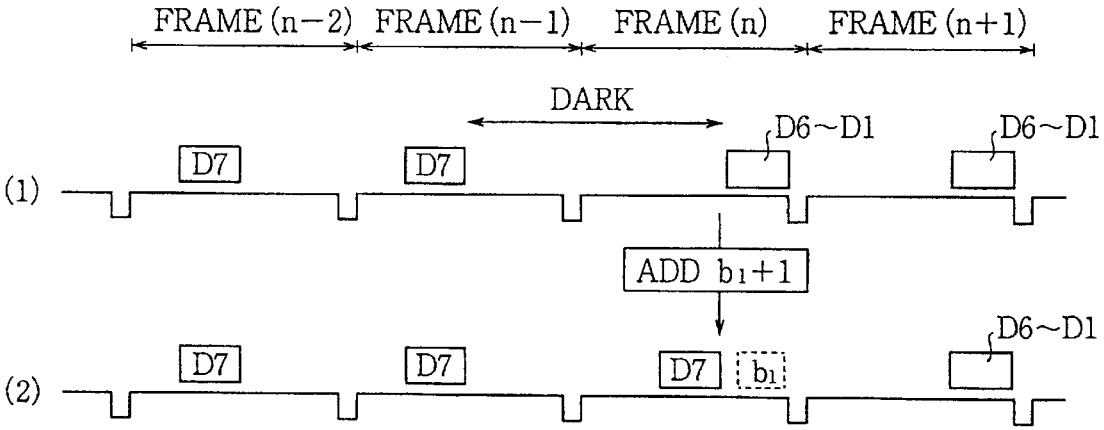

In FIG. 4*c*, the pixel data changes from "01000000", "01000000", "00111111" to "00111111" during the frames (n−2) to (n+1). Namely, the light emitting periods change from the sub-field $D_7$ to sub-fields $D_6$ to $D_1$ between the frames (n−1) and (n). The non-emitting period shown between the arrows in the chart (1) is so long that dark stripes are shown. However, when the correcting data ($b_1$+1) is added to the pixel data "00111111" for the frame (n), the corrected data becomes "01000000+$b_1$". Hence the light is emitted for a period of the sub-field $D_7$ and a sub-field corresponding to the data $b_1$ as shown in chart (2). The non-emitting period is accordingly shortened, thereby preventing the dark stripes.

As can be seen from the examples, the value of the correcting data $a_1$ to $b_1$ varies in accordance with the position of the highest bit having the high data voltage. Namely, the value $a_1$, which is a correcting value when the highest bit is the highest-order bit $d_8$, is larger than the value $b_1$, which is a correcting value when the highest bit is the next highest bit $d_7$. In other words, it is preferable to set the correcting value to increase as the position of the highest bit of the data becomes higher.

Although the experiments carried out by the inventors of the present invention have shown that the false contouring can be effectively prevented by detecting the high-order four bits of the pixel data, the present embodiment may be modified so as to detect the high-order three bits or the high-order five bits to predict the occurrence of the false contouring.

The change in the position of the highest bit having the high data voltage can be detected through a program executed by a microprocessor.

Although the present pixel data is compared with that of one frame before in the present embodiment, it may be compared with the data of two or three frames before. Moreover, the number of sub-fields, and hence the number of the bits need not be confined to eight, but be a natural number as appropriate.

Figure 5:
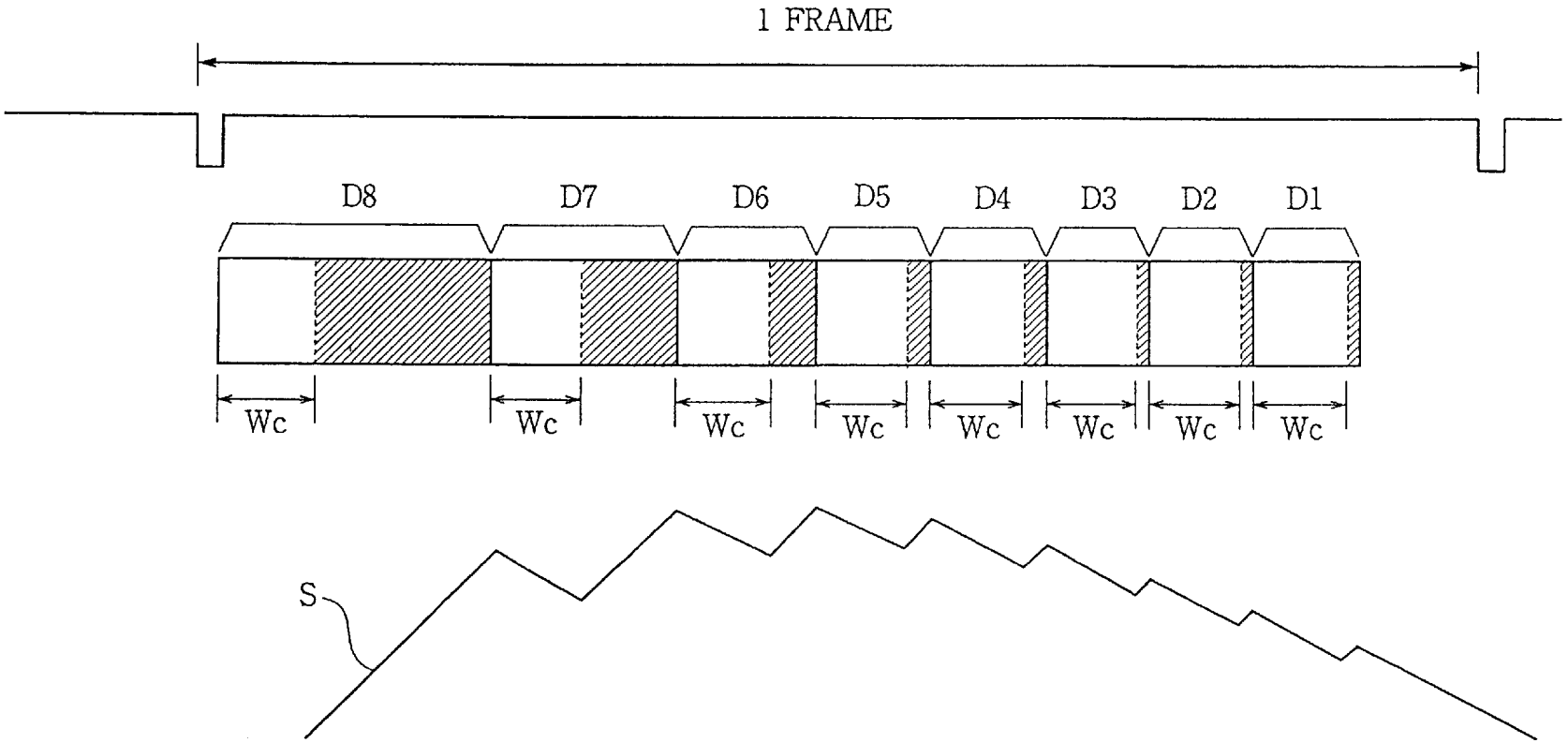
FIG. 5 is a chart explaining emission at sub-fields within one frame and the corresponding visual response.

There has been observed some cases where the false contouring occurs even after the pixel data are corrected as described above. As shown in FIG. 5, when the pixel data having eight bits $d_1$ to $d_8$ of a frame is "11111111", the light is emitted during all sub-fields $D_8$ to $D_1$. Each sub-field comprises a non-emitting period Wc for writing the pixel data, and a light-emitting period shown by hatchings. As the emitting period becomes longer, the viewer senses that the luminance is increased so that visual response S is increased. To the contrary, during each non-emitting period, the sense of luminance decreases so that the visual response S declines.

Figure 6:
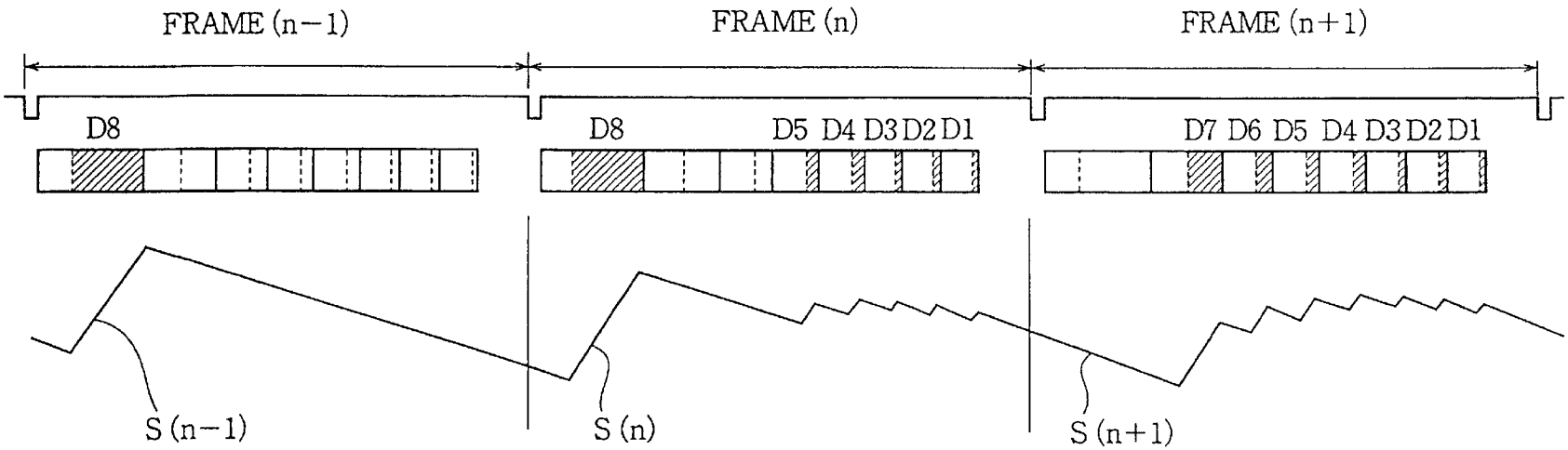
FIG. 6 is a chart explaining the emission at sub-fields within three consecutive frames and the corresponding visual response according to the present invention.

FIG. 6 shows the visual response S in the case of FIG. 4*a* where the data changes from "10000000" to "01111111" and corrected in accordance with the changing pattern $A_1$ of FIG. 3 so that the corrected pixel data in the frame (n) is "10011111". Namely, since in the frame (n−1), the light is emitted for only a period of the sub-field $D_8$ as shown in the chart (2) of FIG. 4*a*, a visual response S(n−1) gradually rises during the sub-field $D_8$ and then declines. In the next frame (n), the light is emitted during the sub-field $D_8$ and during the sub-fields $D_5$ to $D_1$, thereby causing a visual response S(n) to rise during the sub-field $D_8$ and to repeat the risings and declinings thereafter. In the frame (n+1), the light is emitted during the period of sub-fields $D_7$ to $D_1$, a visual response S (n+1) changes as shown in the figure.

Figure 7:
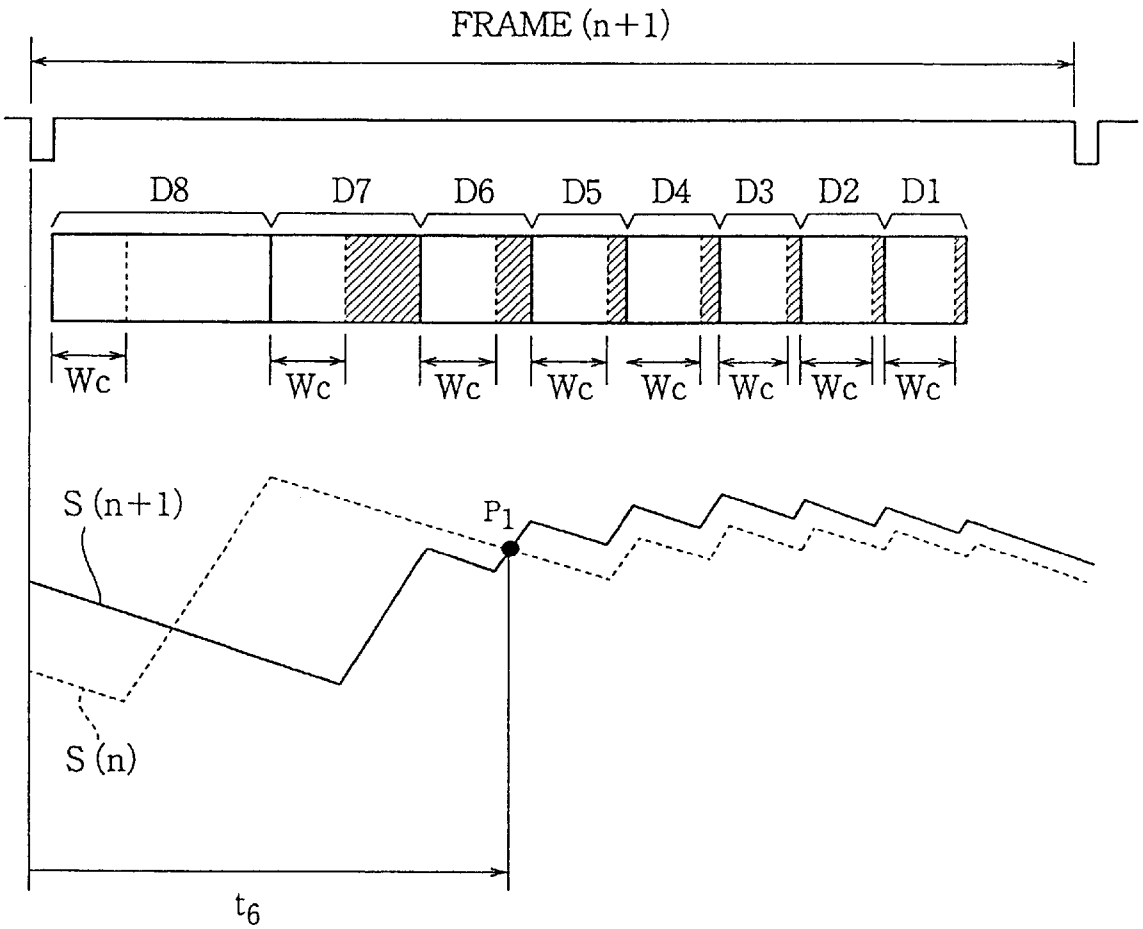
FIG. 7 is a chart showing the visual response when a false contouring occurs.

It has been known that the persistence of the emission in the last frame affects the emission in the present frame. As shown in FIG. 7, in the frame (n+1), the persistence of the visual response S(n) pf the last frame is overlapped with the present visual response S(n+1). After a period to from the start of the frame (n+1), the two responses intersect at a point P1, that is the same luminance is sensed, although one of the responses is headed upward, and the other downward.

Figure 8:
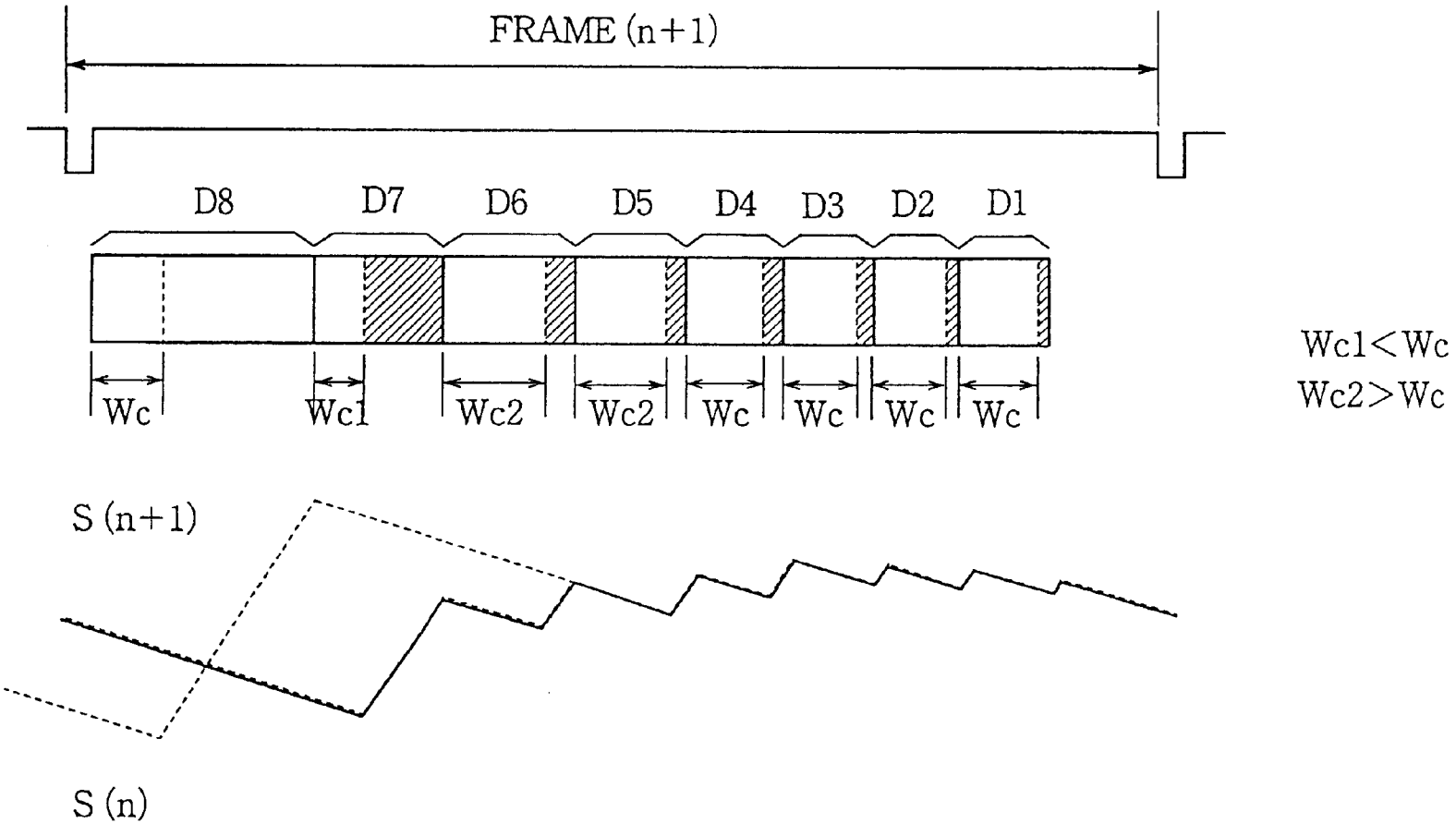
FIG. 8 is a chart showing the visual response when the false contouring is prevented.

The false contouring is observed in such a circumstance. However, the false contouring can be prevented by forcing the attenuating slope of the visual response S(n+1) in the frame (n+1) to coincide with that of the visual response S(n) in the last frame (n) as shown in FIG. 8.

Figure 9:
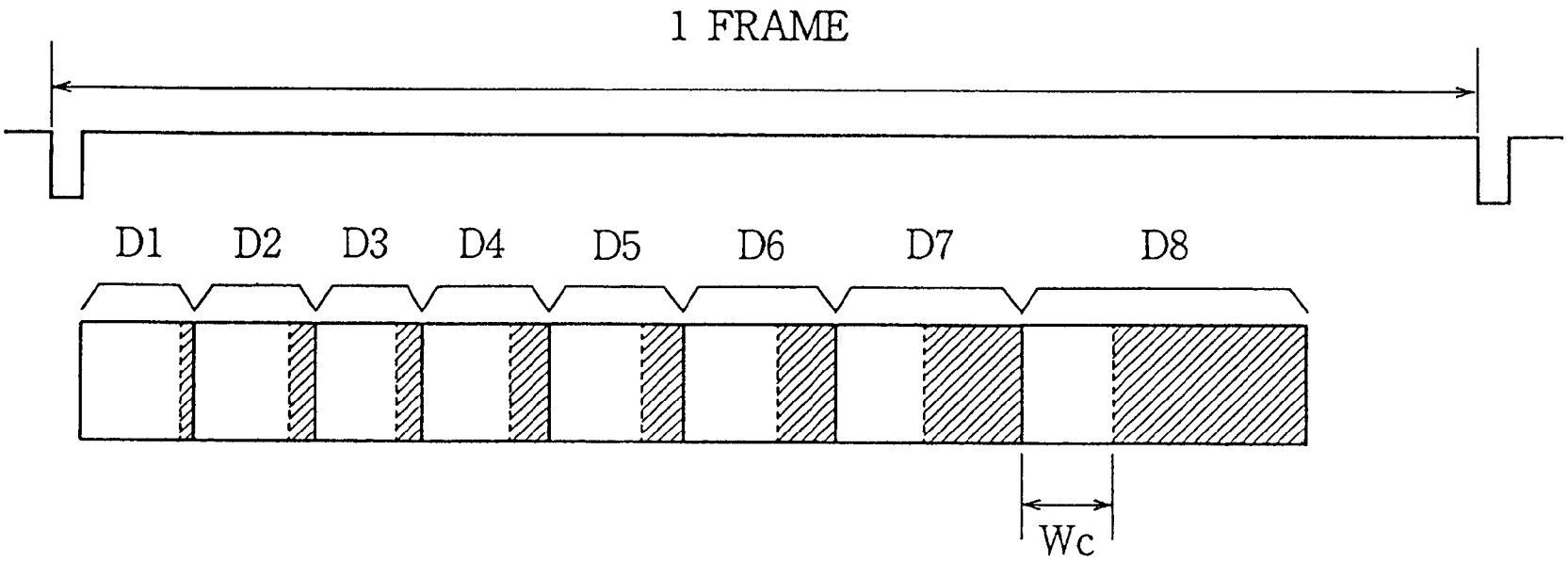
FIG. 9 is a chart showing another arrangement of the sub-fields.

In order to control the visual response, the non-emitting period Wc is corrected. Namely, a non-emitting period $Wc_1$ of the sub-field $D_7$ is rendered shorter than the normal non-emitting period Wc, whereas a non-emitting period $Wc_2$ of each of the sub-fields $D_6$ and $D_5$ is rendered longer. The non-emitting period of other sub-fields may be corrected in order to attain the same result. The same correcting method can be applied to a device where the sub-fields are arranged to start from those of the smaller weight as shown in FIG. 9.

The false contouring can be sufficiently prevented in the above described embodiment if the display is showing a still picture, or the speed at which an image on the display moves is relatively low. However, when the image quickly moves a dark portion generates in a boundary between adjacent sub-fields of "100" and "011". Thus the false contouring appears in a different manner than it would in a still picture.

More particularly, the intensity of the moving false contours varies in accordance with the moving speed of the image. In addition intensity varies within the false contours depending on the moving direction thereof. When the moving speed of the image is faster than one pixel per frame, the bright or the dark stripe becomes more intense than the still false contour. The intensity increases with the increase of the speed.

The second embodiment of the present invention is intended to prevent such a moving false contour.

Figure 10:
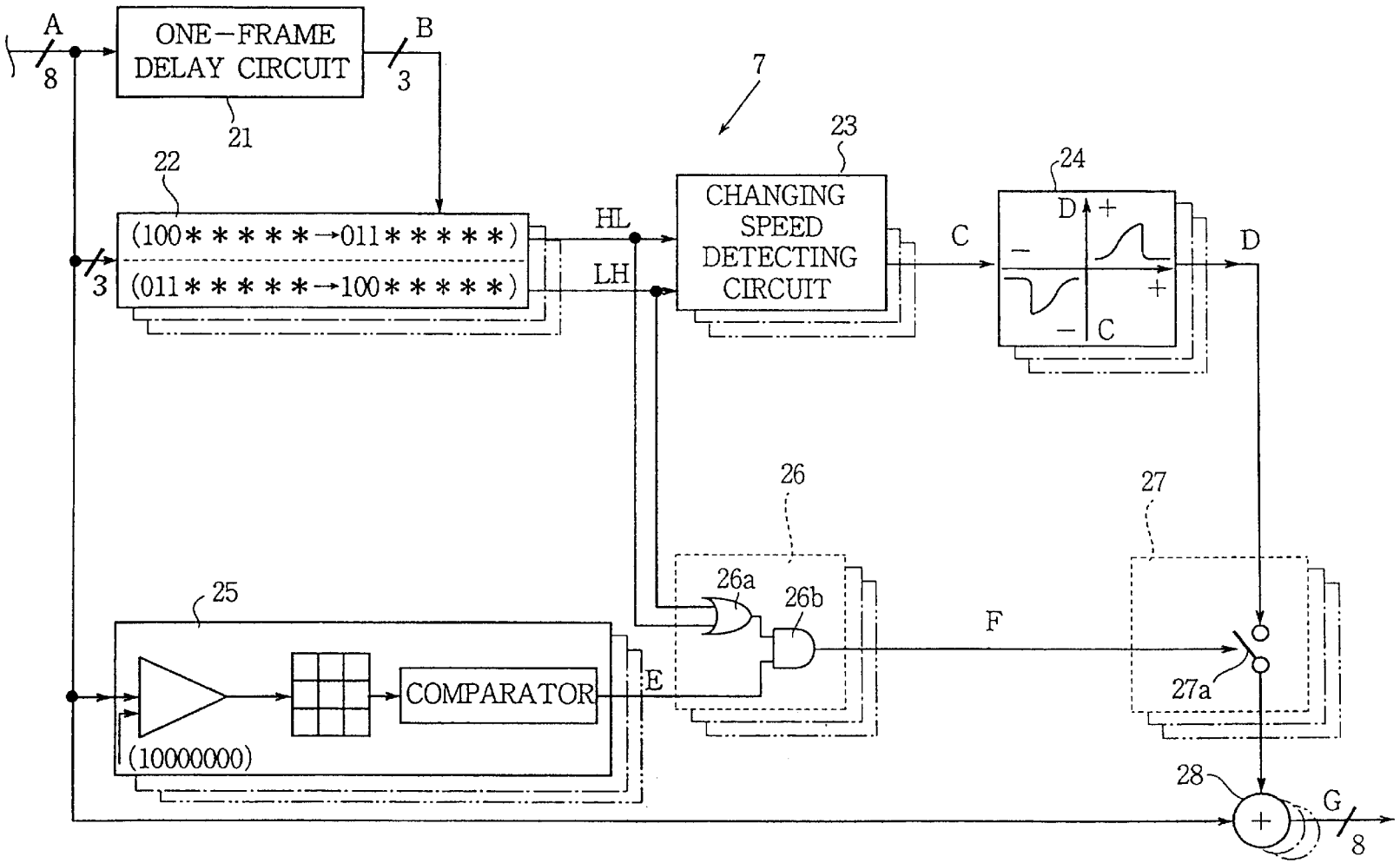
FIG. 10 is a circuitry showing a second embodiment of the correcting circuit provided in the control system of FIG. 1.

Referring to FIG. 10, the correcting circuit 7 has a one-frame delay circuit 21 to which the present pixel data from the A/D converter 3 of FIG. 1, designated A in the figure, is fed. The one-frame delay circuit 21 comprises a RAM for storing the present pixel data A and a pixel data B of one frame before, and a read/write control circuit for reading the last pixel data B from an address in the RAM and writing the present pixel data A at the address as the last pixel data. The pixel data A and B are applied to an inter-frame change detecting circuit 22.

Figure 11:
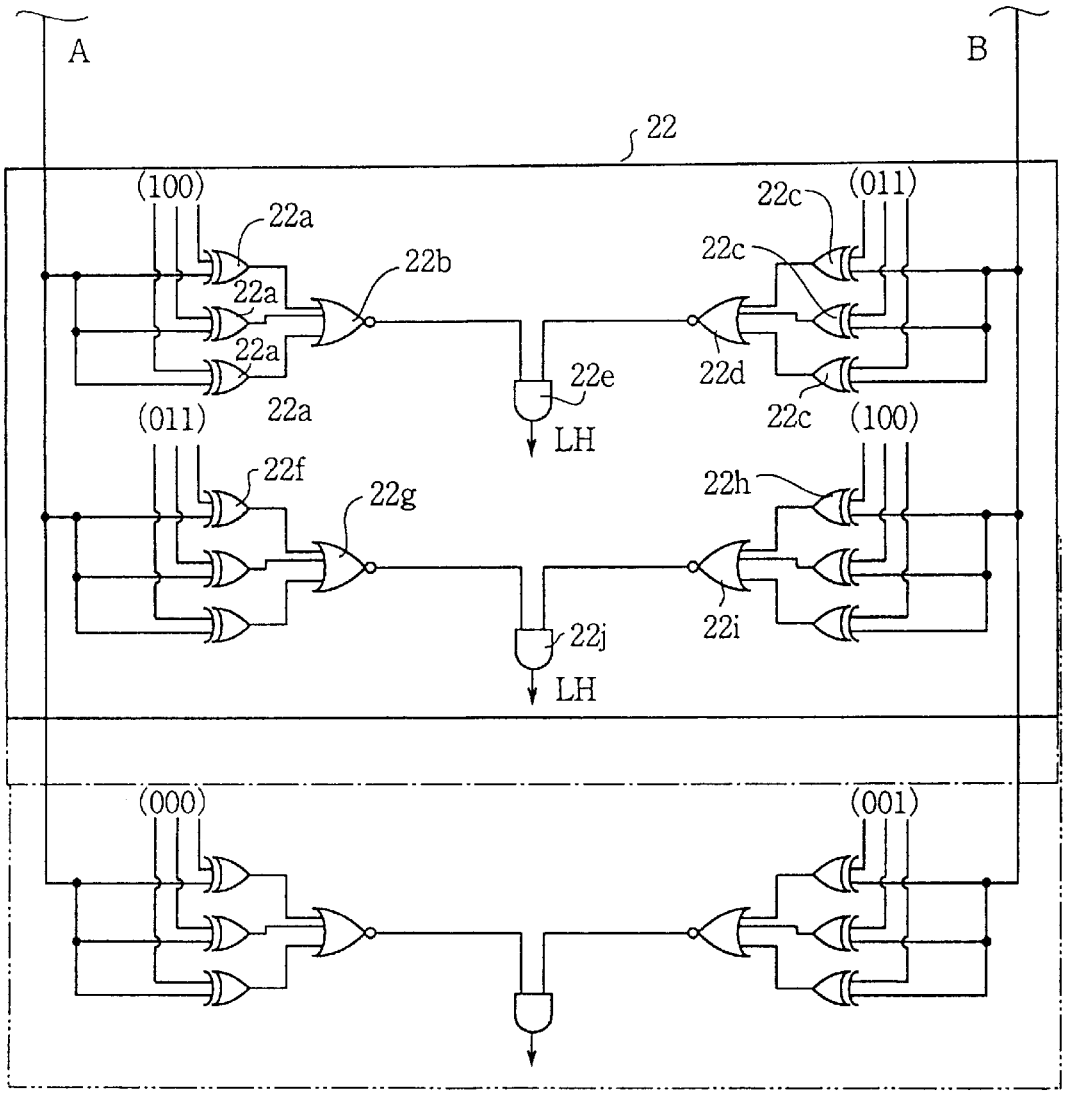
FIG. 11 is a circuitry showing a device provided in the correcting circuit of FIG. 10.

Referring to FIG. 11, the inter-frame change detecting circuit 22 comprises three exclusive OR gates 22*a* to which the values "1", "0", and "0" are respectively fed. The high-order three bits of the present pixel data A are also fed to the exclusive OR gates so as to be compared with the respective values. Namely, when the high-order three bits of the pixel data A is "100", each of the exclusive OR gates 22*a* produces a low level output. The outputs are applied to a NOR gate 22*b* which accordingly produces a high level output. Similarly, the high-order three bits of the last pixel data B are compared with values "0", "1" and "1" by three exclusive OR gates 22*c*, each of which produces a low level output when the three bits are "011". The low level outputs of the exclusive OR grates 22*c* are applied to a NOR gate 22*d* which produces a high level output.

The high level outputs of the NOR gates 22*b* and 22*d* are applied to an AND gate 22*e* which produces a high level output as an increasing signal LH. That is to say, the inter-frame change detecting circuit 22 detects that the values of the MSB and the following two bits are changed, so as to increase luminance.

The inter-frame change detecting circuit 22 is further provided with means for detecting the decrease of the luminance comprising three exclusive OR gates 22*f* and a NOR gate 22*g*, three exclusive OR gates 22*h* and a NOR gate 22*i*, and an AND gate 22*j*. When the exclusive OR gates 22*f* detect that the high-order three bits of the present pixel data A is "011", the NOR gate 22*g* produces a high level output which is applied to the AND gate 22*j*. When the exclusive OR gates 22*h* detect that the high-order three bits of the last pixel data B is "100", the NOR gate 22*i* applies a high level output to the AND gate 22*j*. Thus, the AND gate produces a high level output as a decreasing signal HL.

Namely, the inter-frame change detecting circuit 22 detects that the value of MBT and those of the two following lower bits in the last frame are each changed from the last frame in the present frame.

As shown by the dash-dot lines and dash-two-dot lines in FIGS. 10 and 11, there are further provided two other inter-frame change detecting circuits which determine the changes of values of the second and third highest order bits, for example, from "010"to "001". The inter-frame change detecting circuit 22 may be adapted to detect the change of data in high-order two bits and high-order four bits. The circuit may also be modified to detect the change such as "10****" to "01**", and from "01**" to "10**" so as to expand the detecting range, thereby improving the effect of the correction. The detecting range is also expanded when the changes such as from "1***" to "0***", from "01**" to "00**", and from "001*" to "000***" are detected.

Referring back to FIG. 10, the decreasing signal HL and the increasing signal LH are fed to a changing speed detecting circuit 23. When the picture moves, the number of pixel inversion between frames increases in one of polarities. This is statistically correct. The following system detects the speed of the false contour by counting the number of pixels which invert between frames in one of polarities.

Figure 12A:
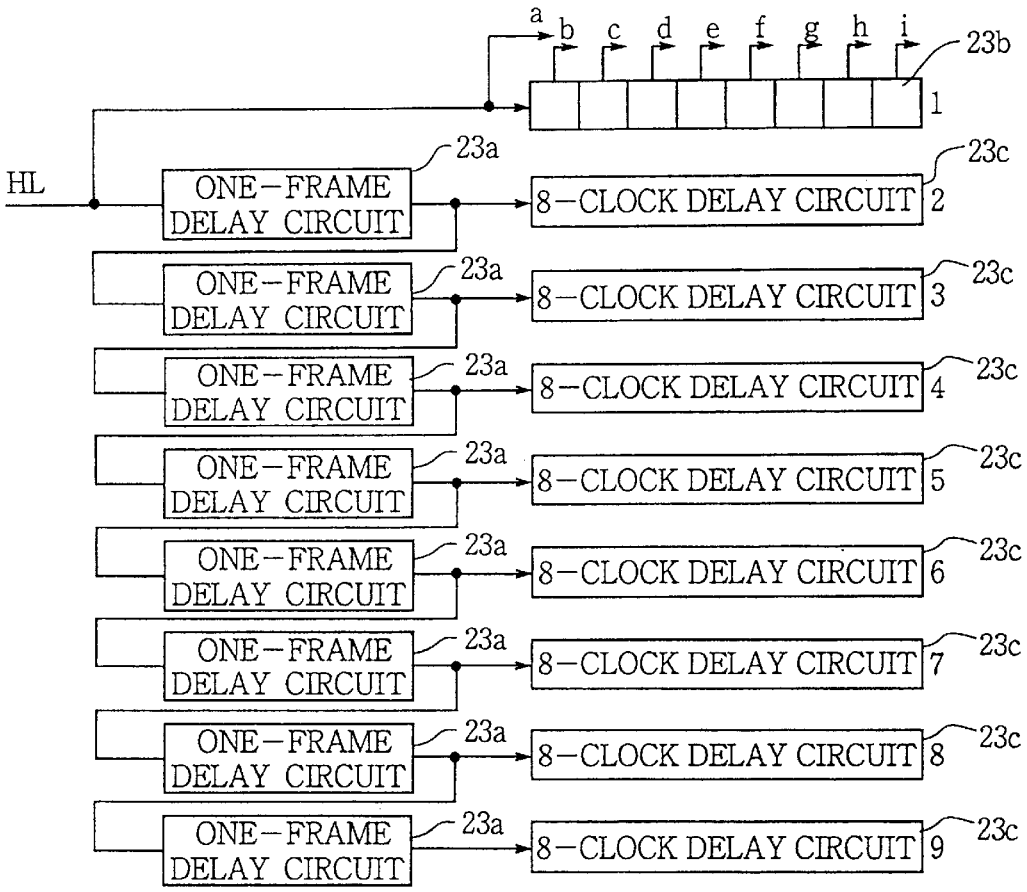
FIG. 12*a* is a block diagram showing another device provided in the correcting circuit of FIG. 10.
Figure 12B:
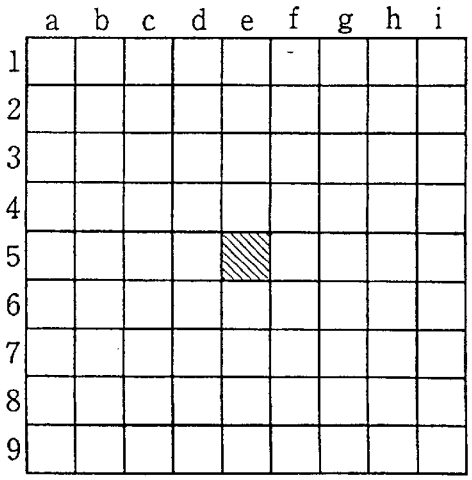
FIG. 12*b* shows a matrix of pixels for explaining the operation of the device of FIG. 12*a*.

As shown in FIG. 12*a*, the changing speed detecting circuit 23 comprise serially connected one-horizontal scanning interval delay circuit 23*a* for eight horizontal pixels, an 8-bit shift register 23*b* and 8-clock delay circuits 23*c* for eight vertical pixels, each receiving an output of corresponding one horizontal scanning interval delay circuit 23*a*. When the decreasing signal HL or the increasing signal LH is applied, the changing speed detecting circuit 23 repairs to the pixels in a matrix of nine rows by nine columns including the present pixel shown in hatchings at the center thereof as shown in FIG. 12*b*. Namely, the changing speed detecting circuit 23 calculates the number of pixels where the bit of the highest order having the high data voltage had changed. Each of the one horizontal scanning interval delay circuits 23*a* stores the data on pixels in one of the rows. The matrix of FIG. 12*b* is formed by the substantially same method for forming the matrix of FIG. 14*b* which will be hereinafter described.

Figure 13:
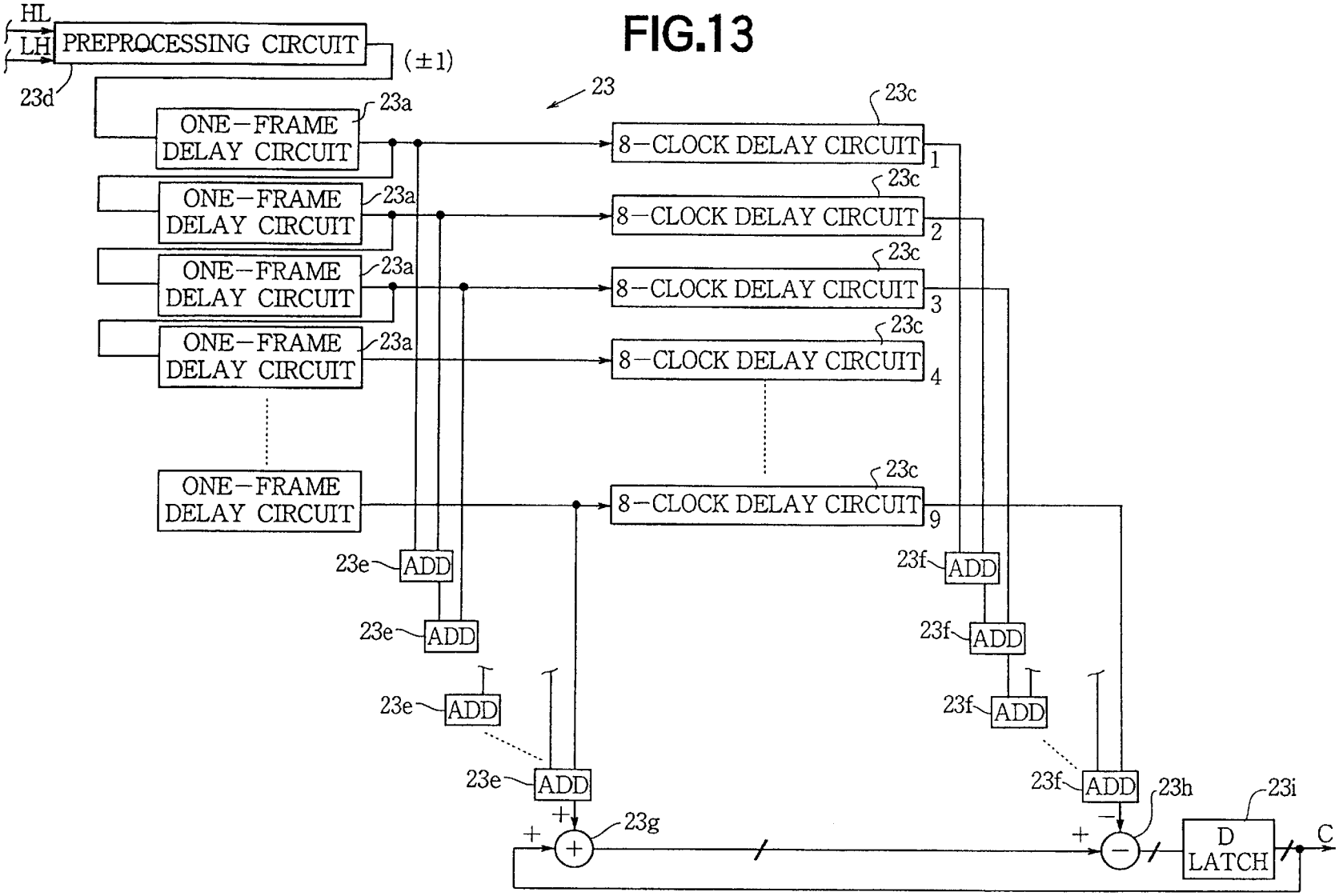
FIG. 13 is a block diagram showing another example of the device shown in FIG. 12*a*.

It is preferable to provide two sets of the delay circuits 23*a* and 23*c* for each of the decreasing signal and the increasing signal. However, such an additional device improves an increase of the circuitry and a decrease in calculating speed. Hence, in the present embodiment, a preprocessing circuit 23*d* connected to the first delay circuit 23*a* is provided as shown in FIG. 13. The preprocessing circuit 23*d* is applied with the decreasing signal HL or the increasing signal LH. When the bit having the high data voltage moves to a lower position, −1 is stored in the first delay circuit 23*a*. On the other hand, when the bit moves to a higher position, +1 is stored. When the position of the bit does not change, −1 and +1 are alternatively stored. In the next row, the storing order of the values −1 and +1 for the unchanging pixels is changed.

The delay circuits 23*a* are connected to respective adders 23*e*, each of which adds the values stored in each delay circuit. The values stored in the delay circuits 23*c* are added at adders 23*f*. The total of the values in the delay circuit 23*c* added at the adders 23*f* are subtracted from the total of the delay circuit 23*b* at a subtracter 23*h* to obtain the number of the pixels which have changed. The number of the pixels is stored in a latch 23*i* and further applied to an adder 23*g* to be added to the total of the adders 23*e*. Hence, the number of pixels in the front portion of the matrix of nine by nine is added and the number of the pixels in the rear portion is subtracted.

The changing speed detecting circuit 23 thus calculates a value C representing the number of the pixels the data of which have changed and the manner of the change in the nine by nine matrix. Thus, the speed of the false contour is detected. Although the value may include small errors, it approximately indicates the changing speed.

As shown in FIG. 10, the calculated value C is fed to a correcting data calculator 24 having a ROM storing a plurality of correcting data D. The data D is set to increase as the value C increases as shown in a graph in FIG. 10. However, when the number of the changing pixels exceeds a predetermined value, for example, 45 which is more than the half of all the pixels in the nine by nine matrix, the detected value C is considered as an error so that the correcting data D is decreased.

The pixel data A is further applied to an intra-frame change detecting circuit 25 in FIG. 10. The detecting circuit 25 compares the data A with those of eight adjacent pixels in a three by three matrix as shown in FIG. 14*b*.

Figure 14A:
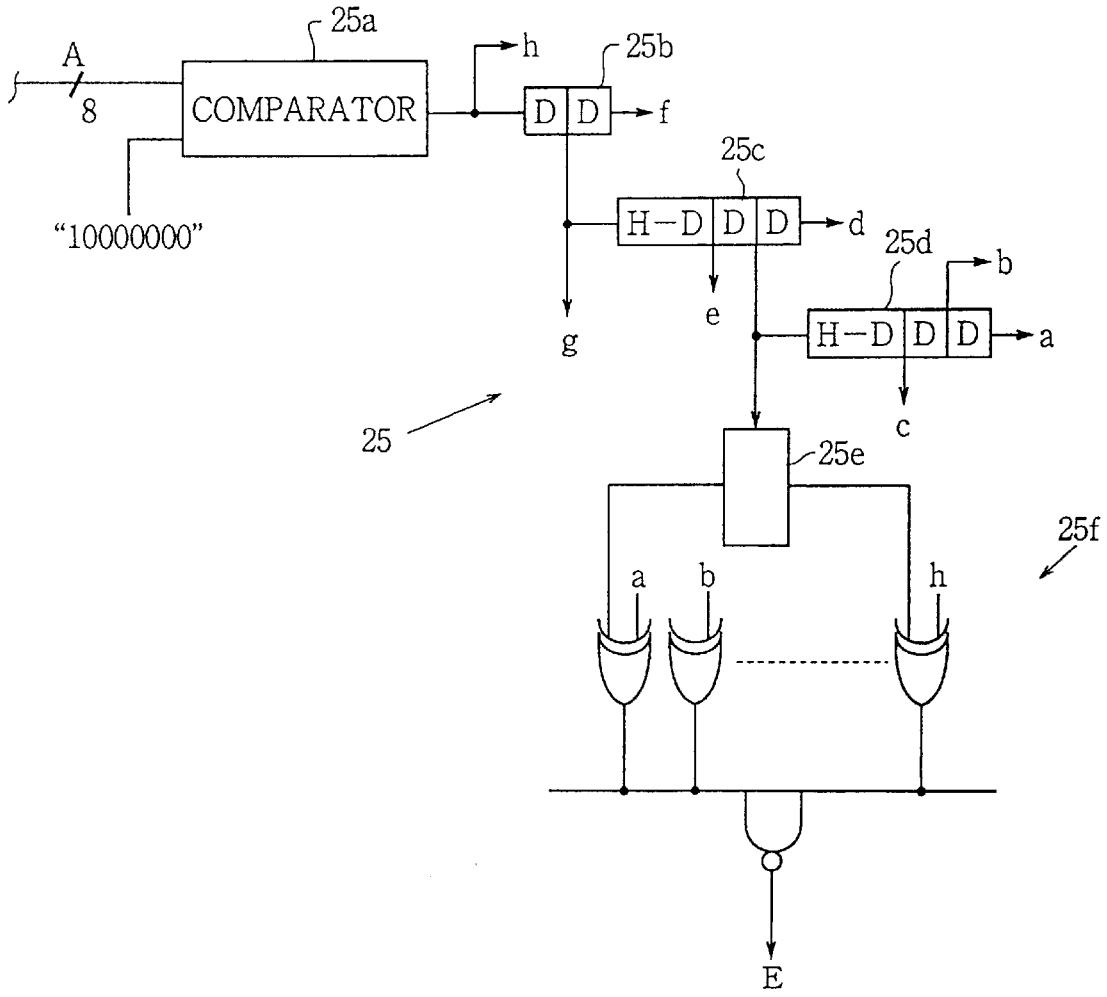
FIG. 14*a* is a diagram showing another device provided in the correcting circuit of FIG. 10.
Figure 14B:
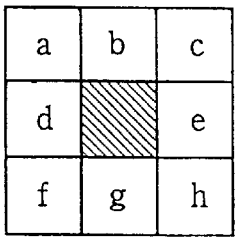
FIG. 14*b* shows a matrix of pixels for explaining the operation of the device of FIG. 14*a*.
Figure 15A:
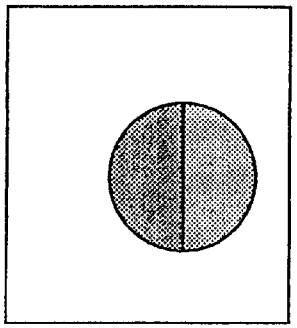
FIGS. 15*a* to 15*d* and 16 to 20 are illustrations explaining the operation of the second embodiment.
Figure 15B:
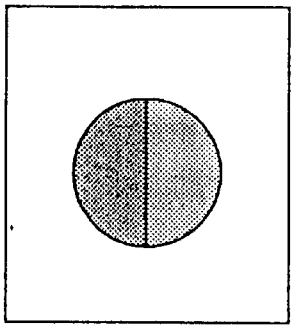
Figure 15C:
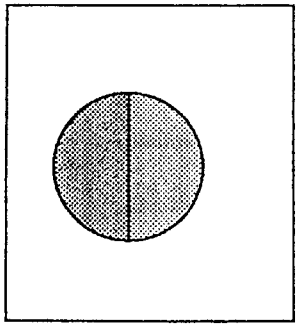
Figure 15D:
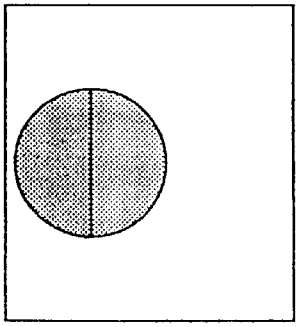

Referring to FIG. 14*a*, the in-space change detecting circuit 25 has a comparator 25*a* for comparing the pixel data A with the data "10000000", a first delay circuit 25*b*, second delay circuit 25*c*, and third delay circuit 25*d*. In each of the delay circuits, the reference D represents a one-clock delay circuit, and H represents a one horizontal scanning interval delay circuit. Thus, the first to third delay circuits 25*b*, 25*c* and 25*d* produce pixel data a to h of the matrix of FIG. 14*b*.

The intra-frame detecting circuit 25 has a comparator 25*f* for comparing the present pixel 25*e* with the eight pixels a to h in the three by three matrix. When the present pixel 25*e* differs from any one of the eight pixels, the comparator 25*f* produces a change detecting signal E.

The present pixel may be compared with four pixel disposed above, below, right and left thereof. The pixels the data of which is compared with the present data may be determined in accordance with an existing noise component, thereby increasing the accuracy of the detection. Furthermore, a movement detecting circuit for detecting the direction of the movement may be provided so that the pixels in the moving direction is compared with the present pixel, thereby further increasing the detecting accuracy.

The change detecting signal E is applied to a false contouring detecting circuit 26 (FIG. 10). The determining circuit 26 is provided with an OR gate 26*a* to which the increasing signal LH and the decreasing signal HL are fed. The output of the OR gate 26*a* and the detecting signal E are applied to the input terminals of an AND gate 26*b*. Thus, the AND gate 26*b* produces a high level output as a false contouring detecting signal F when the pixel data have changed and the data differs from those of the surrounding pixels.

The false contouring detecting signal F is applied to a changeover circuit 27 having a switch 27*a* to close the switch. Thus, the correcting data D obtained at the correcting data calculator 24 is accordingly applied to an addition and subtraction circuit 28 to which the pixel data A is fed. The pixel data A is corrected by the correcting data D so that a corrected data G is obtained. Namely, the data is corrected only when the false contouring is anticipated.

The correcting data calculator 24 may be modified to provide a ROM wherein the corrected data G in accordance with the changing speed C are stored, thereby obviating the addition and subtraction circuit 28.

As shown by the dash-dot lines and dash-two-dot lines, each of the changing speed detecting circuit 23, correcting data calculator 24, in-space change detecting circuit 25, false contouring detecting circuit 26 and the changeover circuit 27 and the addition and subtraction circuit 28 are provided in three to correspond to the respective inter-frame change detecting circuits 22.

Although descriptions are omitted, various delay circuits are provided in the correcting circuit 7 so that data of the same pixel is processed in each device at one time.

Figure 16:
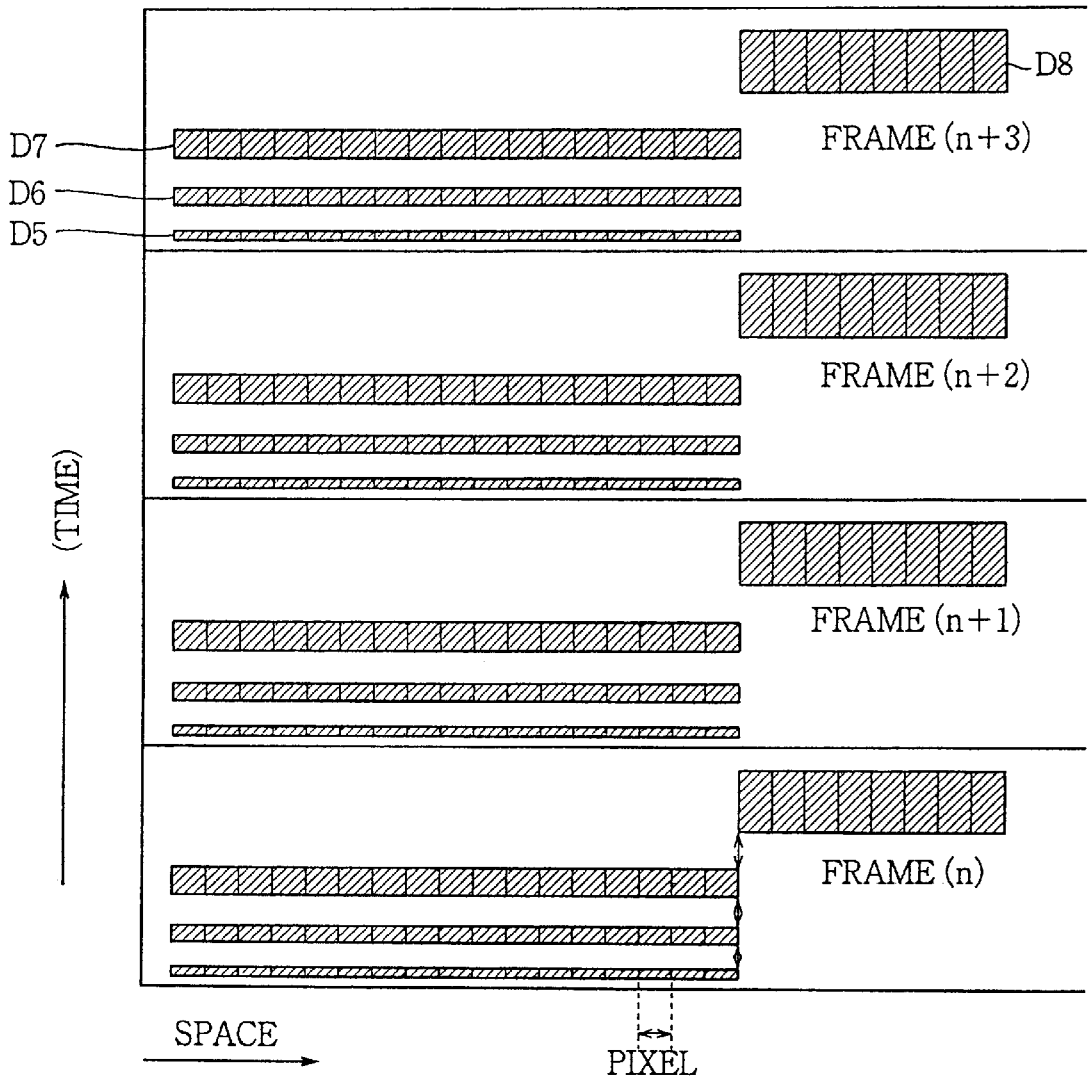

The operation of the present embodiment will be described hereinafter with reference FIGS. 15 to 19. FIG. 16 shows a still image. The abscissa represents the space (pixel) and the ordinate shows time (frame). In figures, only the sub-fields corresponding to high-order four bits are shown. The image radiates at 0111 in the left side portion and at 1000 in the right side portion. The non-radiating portion between rows of pixels is the addressing period.

FIGS. 15*a* to 15*d* show movement of an image where a circular image moves from the right to the left in the display.

Figure 17:
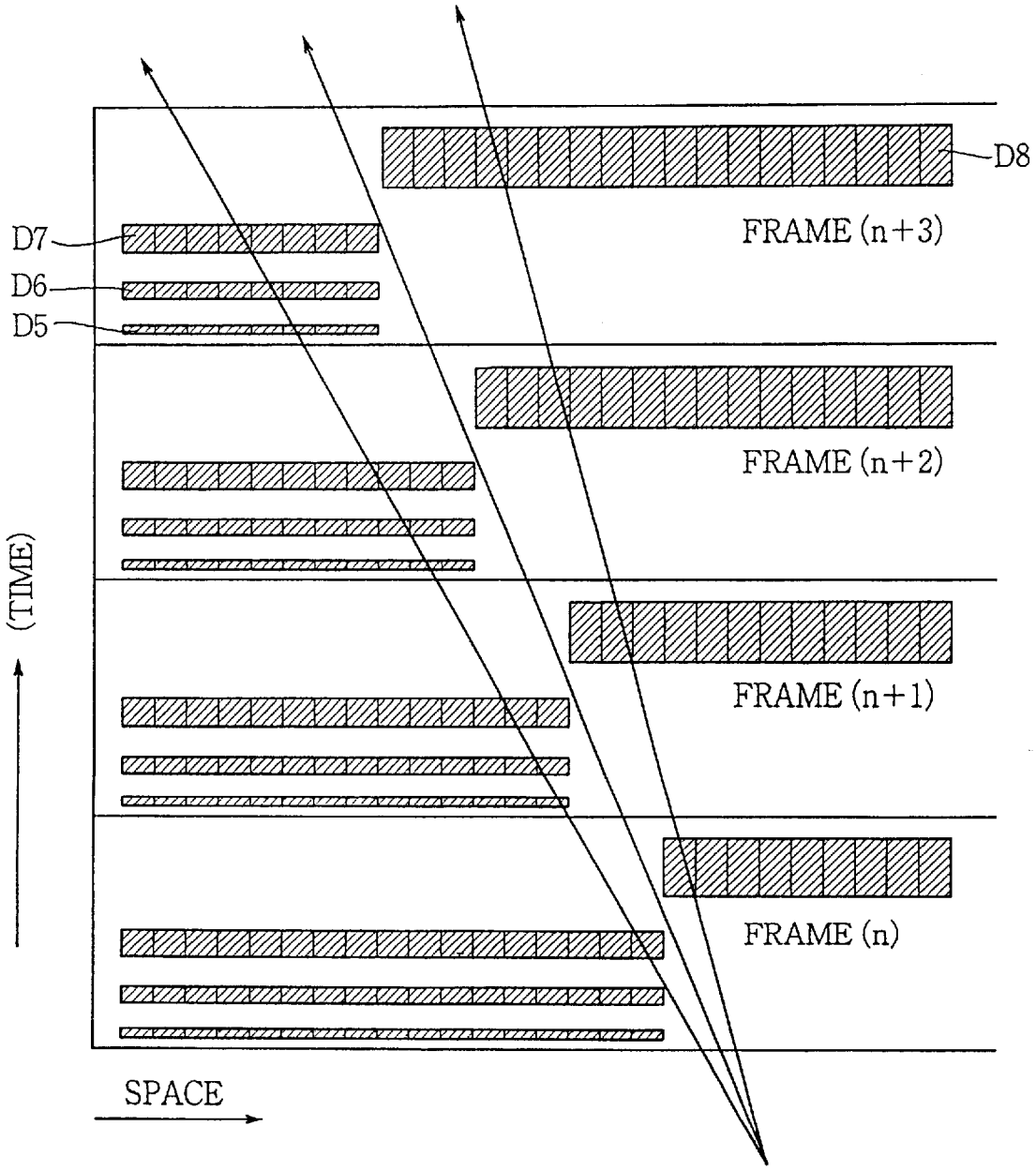

FIG. 17 shows the movement of the bright portion of "100" to the left together with the movement of an image, at a speed of three pixels per frame during the frames F(n) to F(n+3).

Figure 18:
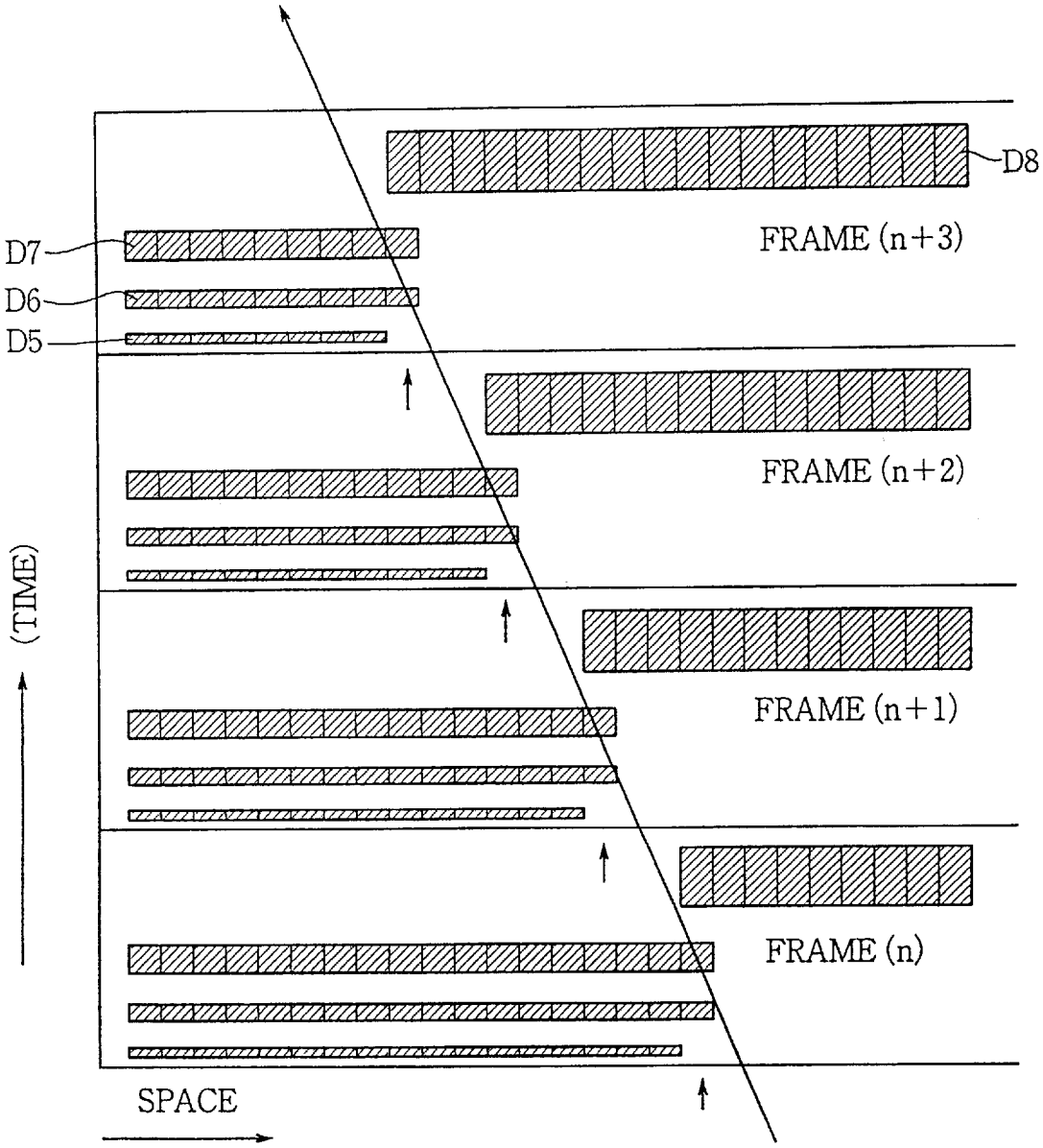

In such a case, a dark line generates in a boundary between sub-fields "100" and "011", where the luminance rapidly decreases in the directions of the arrows. This is the false contour caused by the movement of the image. FIG. 18 shows an example of correcting method in order to prevent the occurrence of the false contouring.

When the pixel data A is corrected to the data G in accordance with the present embodiment, correcting data, that is correcting sub-fields are added at the pixels in the boundary shown by the arrow in each frame. Thus, vacant pockets in each frame are filled with the sub-fields, thereby preventing the false contouring.

Figure 19:
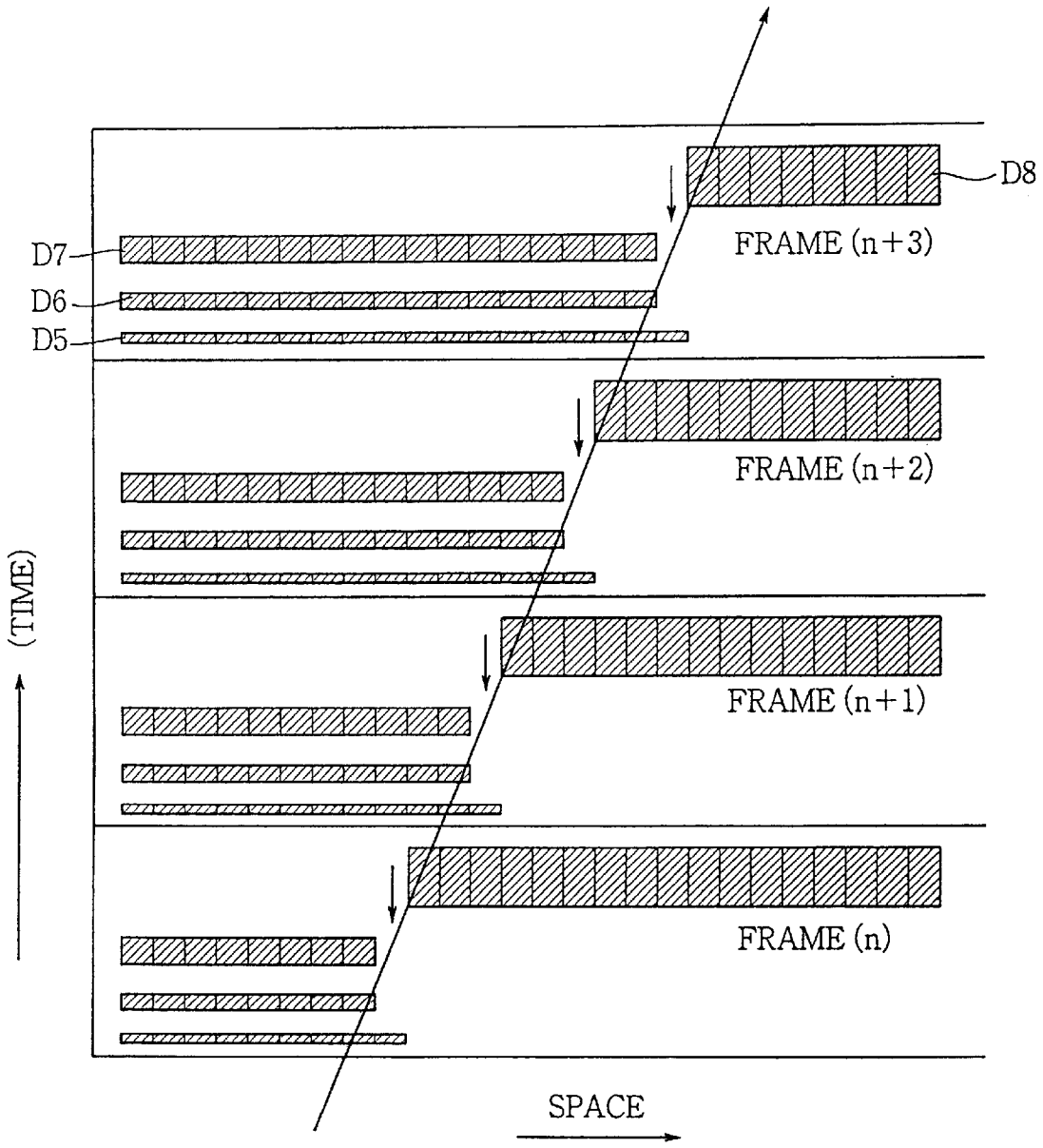

Referring to FIG. 19, when the image moves to the right from "0111" to "1000", false contouring in the form of bright stripes occurs in the boundary as shown by the arrow. The sub-fields are subtracted from the pixels as shown by the arrows in FIG. 19.

Although the present embodiment has been described with respect to the display device wherein the sub-fields are started with the least weighted sub-fields, the sub-fields may be arranged starting with the most weighted sub-field, or arranged in other orders.

Figure 20:
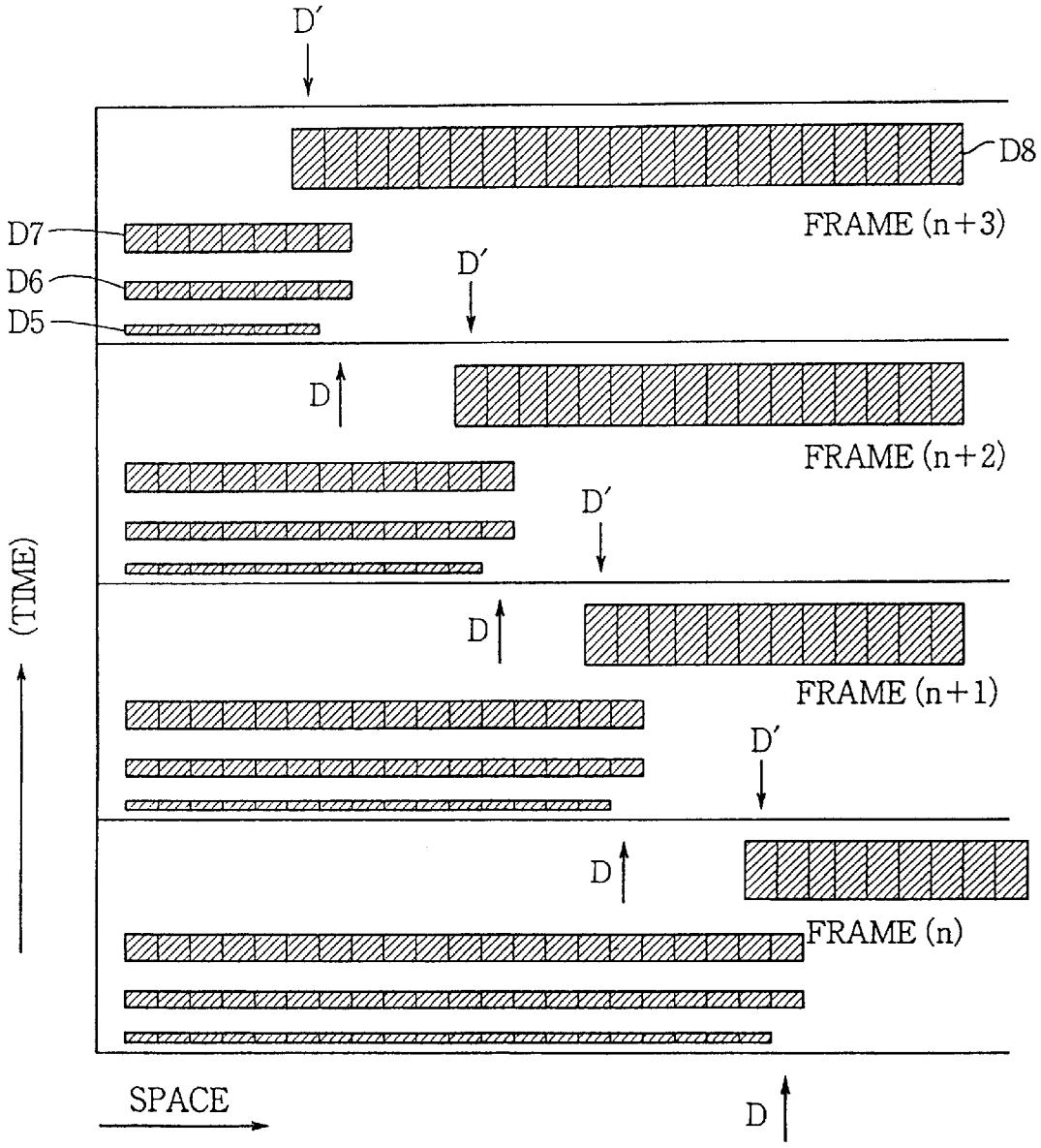

When the moving speed is high, sub-fields are further added to the adjacent pixels as shown by the arrows in FIG. 20.

Figure 21:
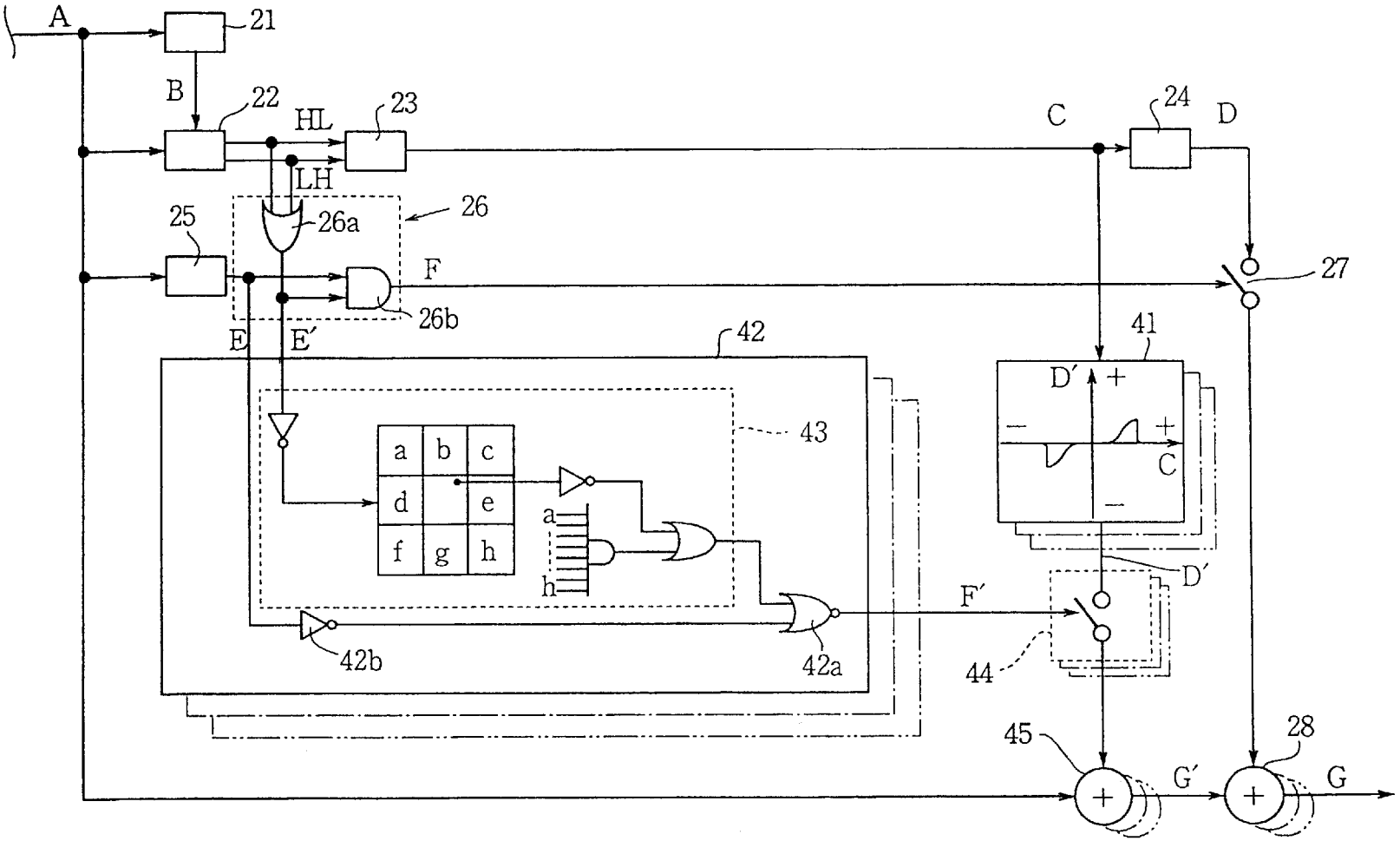
FIG. 21 is a circuitry showing another example of the correcting circuit of FIG. 10.
Figure 22A:
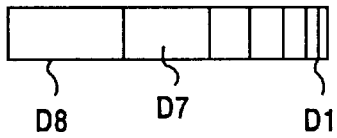
FIG.22a PRIOR ART
FIG. 22*a* is an illustration showing sub-field of a pixel.
Figure 22B:
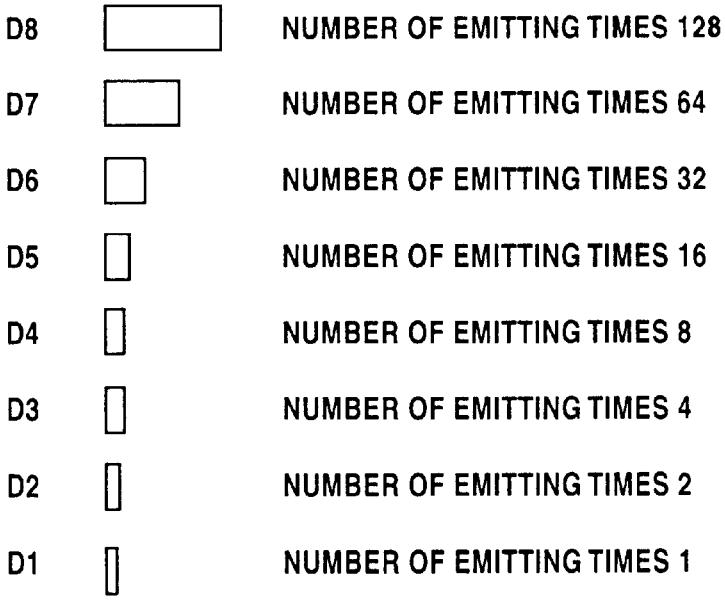
FIG.22b PRIOR ART
FIG. 22*b* is a table showing each sub-fields and the corresponding light-emitting number of times.
Figure 22C:
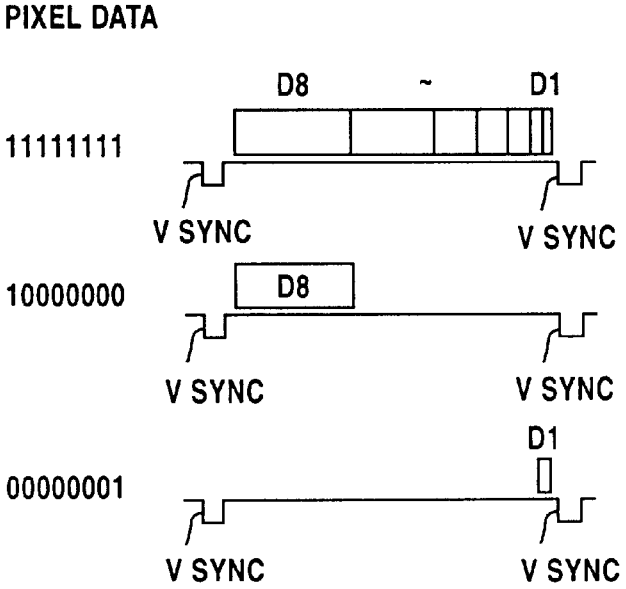
FIG.22c PRIOR ART
FIG. 22*c* shows charts explaining the light-emitting period of the sub-fields.

FIG. 21 shows another example of the control circuit 7 of the present embodiment for preventing the false contouring at a higher moving speed of the image.

The control circuit 7, in addition to the devices shown in FIG. 10, is further provided with a second correcting data calculator 41, second false contouring detecting circuit 42 incorporating a second in-space change detecting circuit 43, second changeover circuit 44, and a second addition and subtraction circuit 45.

The second correcting data calculator 41 is applied with the value C obtained in the changing speed detecting circuit 23. The calculator 41 is provided with a ROM which stores a plurality of correcting data D' in accordance with the value C. As shown by the graph in FIG. 21, the correcting data D' is zero when the moving speed is low and increases with the increase of the moving speed. Hence the correcting data D' is obtained only when the moving speed is larger than a predetermined value.

An in-space change detecting signal E' from the OR gate 26*a* for determining the decrease or the increase of the pixel data of the false contouring detecting circuit 26 is applied to the second change detecting circuit 43. The second change detecting circuit 43 has a one-clock delay circuit, and comparator for comparing the present pixel with the eight pixels in the three by three matrix. Thus pixels subjected to change are determined.

The output signal of the second change detecting circuit 43 is applied to a NOR gate 42*a* of the second false contouring detecting circuit 42. The NOR gate 42*a* is further applied with the change detecting signal E from the in-space change detecting circuit 25 fed through an inverter 42*b*. Thus, when the present pixel is the pixel adjacent to the pixel which forms the front edge of a moving false contour, a second false contouring detecting signal F' is produced.

The second false contouring detecting signal F' is applied to the second changeover circuit 44 to close a switch provided therein. Hence the second correcting data D' is applied to the second addition and subtraction circuit 45 where the pixel data A is corrected by the correcting data D' to obtain a corrected data G'. The corrected data G' is applied to the addition and subtraction circuit 28 so as to be further corrected by the correcting data D. FIG. 20 shows the correcting data D and D'.

Although the pixels in nine by nine matrix were monitored to determine the changing speed in the present embodiment, it is necessary to monitor a larger range when the moving speed becomes high.

From the foregoing it will be understood that the present invention provides a self-luminous display device wherein the false contouring is prevented although the cause thereof may vary.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A method for correcting pixel data in a self-luminous display panel driving system, wherein one field of a video signal is divided into N sub-fields, luminance of each pixel is set by a pixel data comprising N bits corresponding to the number of the sub-field and each of digit positions of the N bits represents a weight for logical value of the luminance, the method comprises the steps of:

comparing a present data of a pixel with a prior pixel data of a same pixel;

detecting that the digit position of a bit of the heaviest weight in the N bits of the present pixel data changes from the digit position of that of the prior pixel data, and producing an inter-frame change signal based upon a detected change;

comparing a present pixel data with pixel data of surrounding pixels;

comparing a present pixel data of a pixel with a prior pixel data of adjacent pixels;

detecting that the digit position of a bit of the heaviest weight in the N bits of at least one pixel data changes from the digit position of that of the present pixel data, and producing an in-space change signal based upon a detected change;

detecting a pixel to be corrected based upon the inter-frame change signal and the in-space change signal; and correcting the pixel data of the pixel to be corrected based upon the inter-frame change signal and the in-space change signal so as to change the sub-field of the corrected pixel data.

2. The method according to claim 1 further comprising determining speed of the changed pixel, and controlling amount of the correcting sub-field in accordance with a determined speed.

3. The method according to claim 2 wherein the speed of the changed pixel is determined, in a local range including the changed pixel, by the number of pixels in which the digit position of the heaviest weighted bit of each pixel changes at least one digit position.

4. A method for correcting pixel data in a self-luminous display panel driving system, wherein one field of a video signal is divided into N sub-fields, luminance of each pixel is set by a pixel data comprising N bits corresponding to the number of the sub-field and each of digit positions of the N bits represents a weight for a logical value of the luminance, the method comprises the steps of:

comparing a present data of a pixel with a prior pixel data of a same pixel;

detecting that the digit position of a bit of the heaviest weight in the N bits of the present pixel data changes from the digit position of that of the prior pixel data, and producing an inter-frame change signal based upon a detected change;

comparing a present pixel data with pixel data of surrounding pixels;

detecting that the digit position of a bit of the heaviest weight in the N bits of at least one pixel data of surrounding pixels changes from the digit position of that of the present pixel data, and producing an in-space change signal based upon a detected change;

detecting a pixel to be corrected based upon the inter-frame change signal and the in-space change signal; and correcting the pixel data of the pixel to be corrected based upon the inter-frame change signal and the in-space change signal so as to change the sub-field of the corrected pixel data.

5. The method according to claim 4, further comprising determining speed of the changed pixel, and controlling amount of the correcting sub-field in accordance with a determined speed.

6. The method according to claim 5, wherein the speed of the changed pixel is determined, in a local range including the changed pixel, by the number of pixels in which the digit position of the heaviest weighted bit of each pixel changes at least one digit position.

7. A method for detecting a false contour in a self-luminous display panel driving system, wherein one field of a video signal is divided into N sub-fields, luminance of each pixel is set by a pixel data, the method comprises the steps of:

comparing a present data of a pixel with at least one frame prior pixel data of a same pixel;

detecting that the digit position of a bit of the heaviest weight in bits of the present pixel data, each of the bits having a luminance logic value, differs from the digit position of that of the prior pixel data by one digit, and producing an inter-frame converted signal based upon a detected change;

comparing the present pixel data with the pixel data of adjacent pixels;

detecting that the digit position of a bit of the heaviest weight in bits of the present pixel data, each of the bits having a luminance logic value, differs from the digit position of that of the adjacent by one digit pixel data, and producing an in-space converted signal based upon a detected change; and detecting a false contour based upon the inter-frame converted signal and the in-space converted signal.

8. A method for correcting pixel data in a self-luminous display panel driving system, wherein one field of a video signal is divided into N sub-fields, luminance of each pixel is set by a pixel data, the method comprises the steps of:

detecting a moving quantity and a moving direction of a pixel having a level causing a false contour, by comparing a pixel data of a present picture and a pixel data of a prior picture, and correcting a pixel data of a moving pixel having a level causing a false contour in the present picture based on the moving quantity and the moving direction, therein changing a luminance level of the moving pixel.

9. The method according to claim 8 further comprising, changing the number of pixels to be corrected based on the moving quantity of the moving pixel.

10. The method according to claim 8, wherein the number of the pixel to be corrected is increased when the moving quantity of the moving pixel increases.

* * * * *